US009004199B2

(12) United States Patent
Burhan et al.

(10) Patent No.: US 9,004,199 B2
(45) Date of Patent: Apr. 14, 2015

(54) DRILL BITS AND METHODS OF MANUFACTURING SUCH DRILL BITS

(75) Inventors: Yuri Burhan, Spring, TX (US); Gregory T. Lockwood, Pearland, TX (US); Jonan Fulencheck, Tomball, TX (US); Michael G. Azar, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 824 days.

(21) Appl. No.: 12/820,554

(22) Filed: Jun. 22, 2010

(65) Prior Publication Data

US 2010/0320005 A1 Dec. 23, 2010

Related U.S. Application Data

(60) Provisional application No. 61/219,188, filed on Jun. 22, 2009.

(51) Int. Cl.

| | |
|---|---|
| ***E21B 10/36*** | (2006.01) |
| ***E21B 10/46*** | (2006.01) |
| ***E21B 10/42*** | (2006.01) |
| ***B22F 7/06*** | (2006.01) |
| ***E21B 10/54*** | (2006.01) |
| ***E21B 10/55*** | (2006.01) |
| *B22F 5/00* | (2006.01) |

(52) U.S. Cl.

CPC . *E21B 10/42* (2013.01); *B22F 7/06* (2013.01); *B22F 2005/001* (2013.01); *B22F 2998/00* (2013.01); *E21B 10/54* (2013.01); *E21B 10/55* (2013.01)

(58) Field of Classification Search

USPC ..... 175/412, 413, 425, 426

See application file for complete search history.

(56) References Cited

U.S. PATENT DOCUMENTS

| | | | | |
|---|---|---|---|---|
| 4,723,996 | A | 2/1988 | Brunet et al. | |
| 4,991,670 | A * | 2/1991 | Fuller et al. | 175/428 |
| 5,089,182 | A | 2/1992 | Findeisen et al. | |
| 5,290,507 | A | 3/1994 | Runkle | |
| 5,598,621 | A | 2/1997 | Littecke et al. | |
| 5,662,183 | A | 9/1997 | Fang | |
| 5,676,496 | A | 10/1997 | Littecke et al. | |
| 5,957,225 | A * | 9/1999 | Sinor | 175/57 |
| 6,095,265 | A | 8/2000 | Alsup | |
| 6,287,360 | B1 | 9/2001 | Kembaiyan et al. | |
| 6,375,706 | B2 | 4/2002 | Kembaiyan et al. | |
| 6,394,202 | B2 | 5/2002 | Truax et al. | |
| 6,461,401 | B1 | 10/2002 | Kembaiyan et al. | |
| 7,250,069 | B2 | 7/2007 | Kembaiyan et al. | |
| 7,350,599 | B2 | 4/2008 | Lockwood et al. | |
| 7,426,969 | B2 | 9/2008 | Azar | |
| 8,118,119 | B2 * | 2/2012 | Dourfaye et al. | 175/420.2 |

(Continued)

FOREIGN PATENT DOCUMENTS

| | | |
|---|---|---|
| WO | 2008142657 | 11/2008 |
| WO | 2009010934 | 11/2010 |

*Primary Examiner* — Brad Harcourt

(57) ABSTRACT

In one aspect, an impregnated drill bit is provided having at least one insert positioned within at least one of the plurality of blades such that the insert spans more than 75% of the height of the blade and at least a portion of the blade has a blade height of at least 40 mm. In another aspect, an impregnated drill bit is provided having a plurality of blades with at least a portion of at least one blade having a blade height of at least 60 mm. Also provided are methods of manufacturing such impregnated drill bits.

69 Claims, 6 Drawing Sheets

(56) References Cited

U.S. PATENT DOCUMENTS

| | | | | |
|---|---|---|---|---|
| 2001/0020551 | A1* | 9/2001 | Taylor et al. | 175/57 |
| 2004/0245022 | A1* | 12/2004 | Izaguirre et al. | 175/374 |
| 2005/0230150 | A1 | 10/2005 | Oldham et al. | |
| 2006/0278441 | A1* | 12/2006 | Cooley et al. | 175/374 |
| 2007/0160830 | A1 | 7/2007 | Egan et al. | |
| 2007/0175669 | A1 | 8/2007 | Liang et al. | |
| 2008/0017421 | A1 | 1/2008 | Lockwood | |
| 2008/0282618 | A1* | 11/2008 | Lockwood | 51/295 |
| 2009/0120008 | A1 | 5/2009 | Lockwood | |
| 2009/0283334 | A1 | 11/2009 | Durairajan et al. | |
| 2009/0283335 | A1 | 11/2009 | Lockwood et al. | |
| 2009/0283336 | A1 | 11/2009 | Lockwood et al. | |
| 2010/0062253 | A1 | 3/2010 | Egan et al. | |

* cited by examiner

DRILL BITS AND METHODS OF MANUFACTURING SUCH DRILL BITS

CROSS-REFERENCE TO RELATED APPLICATIONS

This application claims priority to U.S. Provisional Application No. 61/219,188, filed Jun. 22, 2009, which is hereby incorporated by reference in its entirety.

FIELD OF THE INVENTION

The invention relates generally to the field of drill bits used to bore holes through earthen formations. More particularly, the invention relates to drill bits and methods for manufacturing such drill bits using a matrix material impregnated with abrasive particles which provide for improved performance and/or cost effectiveness of the drill bits.

BACKGROUND OF THE INVENTION

An earth-boring drill bit is typically mounted on the lower end of a drill string and is rotated by rotating the drill string at the surface or by actuation of downhole motors or turbines, or by a combination of both methods. When weight is applied to the drill string, the rotating drill bit engages the earthen formation and proceeds to form a borehole along a predetermined path toward a target zone.

Different types of drill bits work more efficiently against different formation hardnesses. For example, drill bits containing cutting elements that are designed to shear the formation frequently drill formations that range from soft to medium hard. These cutting elements often have a working surface of polycrystalline diamond (PCD) and are often referred to as polycrystalline diamond compacts (PDCs). Drill bits containing PDCs as the cutting elements are often referred to as PDC drill bits.

Roller cone drill bits are efficient and effective for drilling through formation materials that are of medium to hard hardness. The mechanism for drilling with a roller cone drill bit is primarily a crushing and gouging action in which the cutting elements (e.g., inserts) of the rotating cones are impacted against the earthen formation material. This action compresses the material beyond its compressive strength and allows the drill bit to cut through the earthen formation.

For still harder formation materials, the mechanism for drilling changes from shearing to abrasion. For abrasive drilling, drill bits having fixed abrasive elements are preferred. While PDC drill bits are known to be effective in some formations, they have been found to be less effective for hard, very abrasive formations such as sandstone. For these hard formations, cutting structures that comprise abrasive particles, such as diamond grit, impregnated in a supporting matrix material are effective. In the discussion that follows, drill bits of this type are referred to as "impregnated" drill bits.

Impregnated drill bits are commonly used for boring holes in very hard or abrasive rock formations such as sandstone, quartz, basalt, granite, chert, and dolomite. Impregnated drill bits use a scouring or abrading-type of action to cut the earthen formation. The cutting face of such bits contains abrasive particles distributed within a supporting material to form an abrasive layer. During operation of the drill bit, abrasive particles within the abrasive layer are gradually exposed as the supporting material is worn away. The continuous exposure of new abrasive particles by wear of the supporting material on the cutting face is the fundamental functional principle for impregnated drill bits.

The construction of the abrasive layer is of importance to the performance of impregnated drill bits. The abrasive layer typically contains diamonds and/or other ultra hard particles distributed within a suitable supporting material. The supporting material must have specifically controlled physical and mechanical properties in order to expose the abrasive particles at the proper rate.

Metal matrix composites are commonly used for the supporting material because the specific properties can be controlled by modifying the processing or components. The metal matrix usually combines a hard particulate phase with a ductile metallic binder phase. The hard particles often include metal carbides (e.g., tungsten carbide), refractory materials, and/or ceramic materials. The metallic binder often includes copper or other non-ferrous alloys. Common powder metallurgical methods, such as hot-pressing, sintering, and infiltration are used to form the components of the supporting material into a metal matrix composite. Specific changes in the quantities of the components and the subsequent processing conditions allow control of the hardness, toughness, erosion and abrasion resistance, and other properties of the metal matrix composite.

Proper movement of fluid used to remove the earthen formation cuttings and cool the exposed abrasive particles is important for the proper function and performance of impregnated drill bits. The cutting face of an impregnated drill bit typically includes an arrangement of recessed fluid paths (also referred to as channels or waterways) intended to promote uniform flow from a central plenum to the periphery of the drill bit. The fluid paths usually divide the matrix material into distinct raised blades with abrasive particles exposed on the tops of the blades. The fluid provides cooling for the exposed abrasive particles and forms a slurry with the rock cuttings. The slurry must travel across the blades which contributes to the wear of the supporting material.

An example of a prior art diamond impregnated drill bit is shown in FIG. 1. The impregnated bit 10 includes a shank 24 and a crown 26. Shank 24 is typically formed of steel and includes a threaded pin 28 for attachment to a drill string (not shown). Crown 26 has a cutting face 29 and outer side surface (or gage) 30. Crown 26 typically includes cutting structures such as blades 40. The blades 40 are separated by channels 16 that enable drilling fluid to flow between and both clean and cool the blades 40. Suitably, formers are placed into a mold cavity during the manufacturing process so that the infiltrated impregnated crown 26 includes a plurality of recesses (may also be referred to as holes, pockets or sockets) 34 that are sized and shaped to receive a corresponding plurality of inserts (e.g., hot pressed diamond impregnated inserts) 36. Additional formers are typically included to form recesses for fluid nozzles (not shown). Once crown 26 is formed, inserts 36 are mounted in the recesses 34 and affixed by any suitable method, such as brazing, adhesion, mechanical means such as interference fit, or the like. Alternatively, the inserts 36 may be placed into the mold cavity instead of the formers and subsequently infiltrated.

Impregnated drill bits are typically made from a solid body of matrix material formed by any one of a number of powder metallurgy processes known in the art. During the powder metallurgy process, abrasive particles and a matrix powder are infiltrated with a molten metallic binder material. Upon cooling, the bit body includes the metallic binder material, hard particles, and the abrasive particles suspended both near and on the surface of the drill bit. One example process for making the impregnated matrix for bit bodies involves hand mixing of matrix powder with the abrasive particles and an organic binder to make a paste. The paste is then packed into the desired areas of a mold cavity. The shank of the bit is supported in its proper position in the mold cavity along with any other necessary formers, e.g., those used to form holes to receive fluid nozzles. The remainder of the mold cavity is filled with additional matrix powder and optionally abrasive particles. Finally, an infiltrant metal binder, typically a nickel brass copper based alloy, is placed on top of the charge of powder. The mold is then heated sufficiently to melt the infiltrant binder and held at an elevated temperature for a sufficient period of time to allow it to flow into and bind the powder matrix.

As discussed above, during drilling, the supporting material and the abrasive particles themselves are worn away, thereby exposing new abrasive particles. Therefore, there exists a desire to maximize blade height and to maintain the height for as long as possible in order to drill more of the formation before having to remove the drill bit from the borehole. The cost of drilling a wellbore is proportional to the length of time it takes to drill to the desired depth and location. The time required to drill the well, in turn, is greatly affected by the number of times the worn drill bit must be changed in order to reach the targeted formation. This is the case because each time the drill bit is changed, the entire string of drill pipe, which may be miles long, must be retrieved from the wellbore, section by section. Once the drill string has been retrieved and the new drill bit installed, the bit must be lowered to the bottom of the wellbore on the drill string, which again must be constructed section by section. This process, known as a "trip" of the drill string, requires considerable time, effort and expense.

SUMMARY OF THE INVENTION

In one aspect, embodiments disclosed herein relate to a drill bit comprising a bit body having a central longitudinal axis and a lower end face for engaging a rock formation; a plurality of blades having an upper surface and side surfaces extending from the bit body and separated by a plurality of channels therebetween; and at least one insert having a central longitudinal axis which is positioned within at least one of the plurality of blades such that the insert axis is generally perpendicular to the upper surface of the blade. At least a portion of at least one of the plurality of blades comprises a matrix material impregnated with a plurality of abrasive particles. Suitably, a major portion of the plurality of blades comprises a matrix material impregnated with a plurality of abrasive particles. The insert spans more than 75 percent of the height of the blade and at least a portion of the at least one blade has a blade height of at least 40 mm.

In another aspect, embodiments disclosed herein relate to a drill bit comprising a bit body having a lower end face for engaging a rock formation; and a plurality of blades extending from the bit body and separated by a plurality of channels therebetween. At least a portion of at least one of the plurality of blades comprises a matrix material impregnated with a plurality of abrasive particles and at least a portion of the at least one blade has a blade height of at least 60 mm. Suitably, a major portion of the plurality of blades comprises a matrix material impregnated with a plurality of abrasive particles.

In yet another aspect, embodiments disclosed herein relate to methods of manufacturing such drill bits.

Other aspects and advantages of the invention will be apparent from the following description and the appended claims.

DETAILED DESCRIPTION

Figure 1:
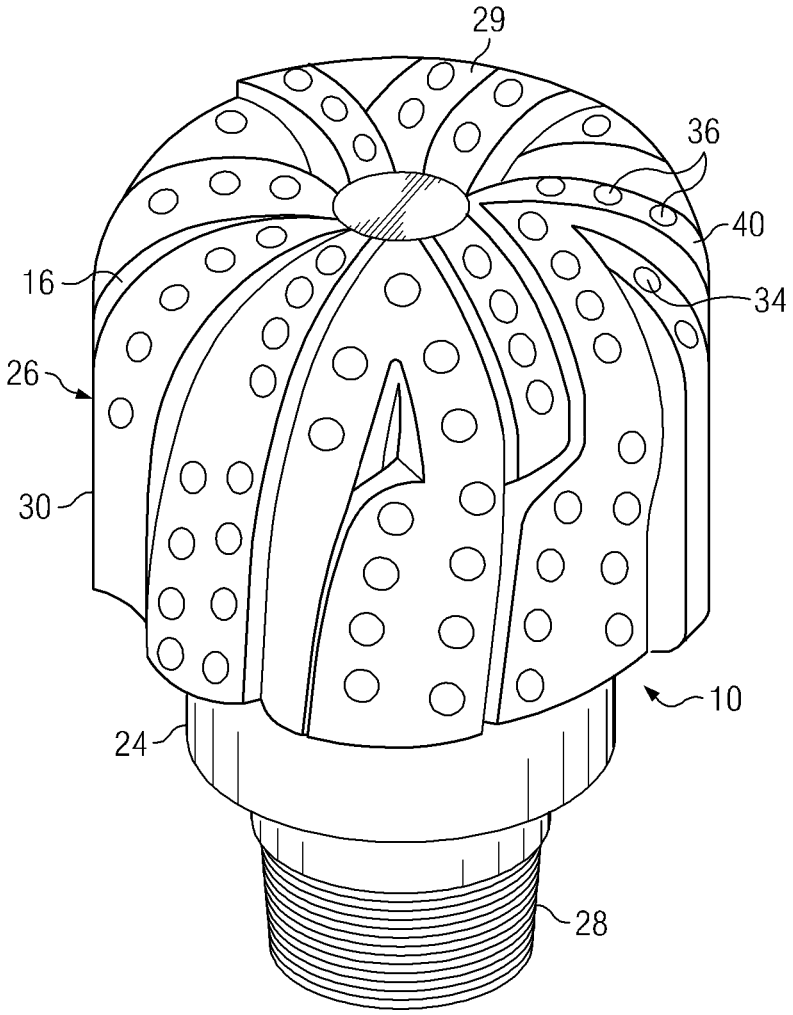
FIG. 1 (PRIOR ART)
FIG. 1 shows a perspective view of an impregnated drill bit.

Embodiments disclosed herein relate to improved impregnated drill bits and methods of manufacturing and using such drill bits. Specifically, embodiments of the present disclosure relate to impregnated drill bits with improved blade structures which can exhibit an improvement in one or more properties such as rate of penetration (ROP), bit durability and/or cost effectiveness.

The following disclosure is directed to various embodiments of the invention. The embodiments disclosed have broad application, and the discussion of any embodiment is meant only to be exemplary of that embodiment, and not intended to intimate that the scope of the disclosure, including the claims, is limited to that embodiment or to the features of that embodiment.

Certain terms are used throughout the following description and claims to refer to particular features or components. As one skilled in the art would appreciate, different persons may refer to the same feature or component by different names. This document does not intend to distinguish between components or features that differ in name only. The drawing figures are not necessarily to scale. Certain features and components herein may be shown exaggerated in scale or in somewhat schematic form and some details of conventional elements may not be shown in the interest of clarity and conciseness.

In the following description and in the claims, the terms "including" and "comprising" are used in an open-ended fashion, and thus, should be interpreted to mean "including, but not limited to . . . ."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, quantities, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of 1 to 4.5 should be interpreted to include not only the explicitly recited limits of 1 to 4.5, but also include individual numerals such as 2, 3, 4, and sub-ranges such as 1 to 3, 2 to 4, etc. The same principle applies to ranges reciting only one numerical value, such as "at most 4.5", which should be interpreted to include all of the above-recited values and ranges. Further, such an interpretation should apply regardless of the breadth of the range or the characteristic being described.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

When using the term "different" in reference to materials used, it is to be understood that this includes materials that generally include the same constituents, but may include different proportions of the constituents and/or that may include differently sized constituents, wherein one or both operate to provide a different mechanical and/or thermal property in the material. The use of the terms "different" or "differ", in general, are not meant to include typical variations in manufacturing.

As used herein, the mesh sizes refer to standard U.S. ASTM mesh sizes. The mesh size indicates a wire mesh screen with that number of holes per linear inch, for example a "16 mesh" indicates a wire mesh screen with sixteen holes per linear inch, where the holes are defined by the crisscrossing strands of wire in the mesh. The hole size is determined by the number of meshes per inch and the wire size. When using ranges to describe sizes of particles, the lower mesh size denotes (which may also have a "−" sign in front of the mesh size) the size of particles that are capable of passing through an ASTM standard testing sieve of the smaller mesh size and the greater mesh size denotes (which also may have a "+" sign in front of the mesh size) the size of particles that are incapable of passing through an ASTM standard testing sieve of the larger mesh size. For example, particles having sizes in the range of from 16 to 35 mesh (−16/+35 mesh) means that particles are included in this range which are capable of passing through an ASTM No. 16 U.S.A. standard testing sieve, but incapable of passing through an ASTM No. 35 U.S.A. standard testing sieve.

Figure 2:
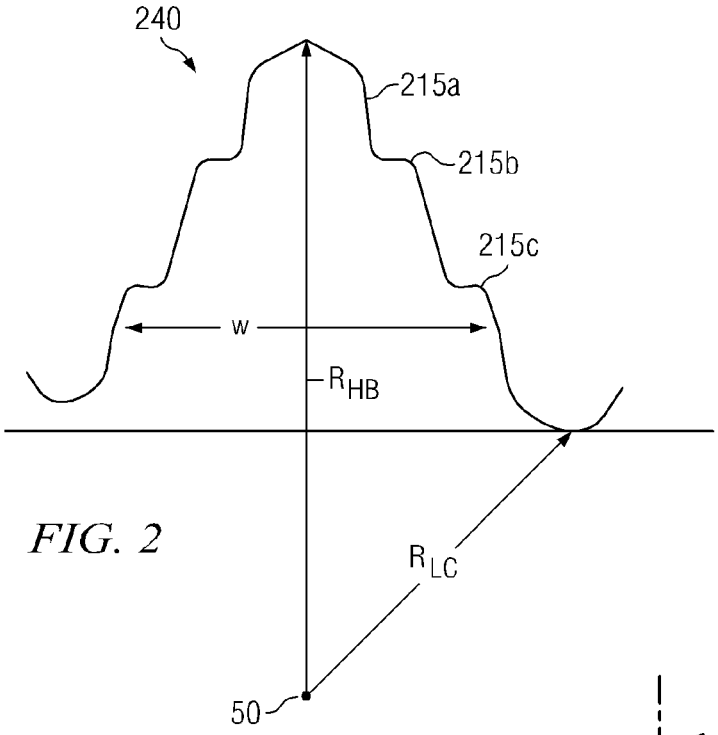
FIG. 2 shows a cross-sectional view of a blade of a drill bit according to one or more embodiments of the present disclosure.

As used herein, unless specified otherwise, the term "blade height" refers to the difference in distance between the uppermost surface of the blade (excluding any portion of the blade surface created by an insert) to the bit center (i.e., a reference point along the bit axis) and the lowest most portion of the surface of the deepest channel to the bit center (i.e., lowest most channel or channel closest to the bit center). Suitably, the channel nearest the bit center may be within five adjacent channels on either side of the blade to be measured, more suitably the channel nearest the bit center may be within three adjacent channels on either side of the blade to be measured. In other words, the channel nearest the bit center, used to measure the blade height, may or may not be adjacent the blade for which the blade height is being measured. As shown in FIG. 2, this distance, blade height "$h_b$", may be measured by determining the difference in length between a reference line drawn from a reference point along the bit axis (50) to the uppermost surface of the blade being measured ($R_{HB}$ having a length $L_{HB}$ (not depicted)) and a line drawn from the reference point to the lowest most portion of the surface of the channel nearest the bit center ($R_{LC}$ having a length $L_{LC}$ (not depicted)) (i.e., $h_b=L_{HB}-L_{LC}$), measured at the same radial distance from the bit axis 50. As used herein, the terms "axial" and "axially" generally mean, unless specified otherwise, along or parallel to the bit axis (e.g., bit axis 11), while the terms "radial" and "radially" generally mean, unless specified otherwise, perpendicular to the bit axis. For instance, an axial distance refers to a distance measured along or parallel to the bit axis, and a radial distance refers to a distance measured perpendicularly from the bit axis.

Figure 16:
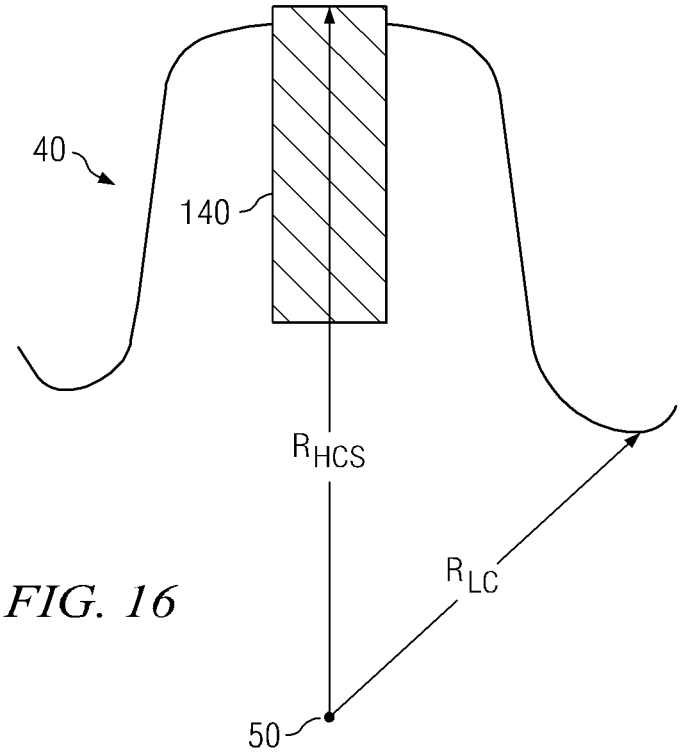
FIG. 16 shows a cross-sectional view of a blade of a drill bit according to one or more embodiments of the present disclosure.

As used herein, unless specified otherwise, the term "cutting structure" refers to the blades and any inserts or polycrystalline diamond compacts disposed on the blades. As illustrated in FIG. 16, the cutting structure may have a "cutting structure height '$h_{cs}$'" which unless specified otherwise refers to the difference in distance between the uppermost surface of the cutting structure, including any insert 140 or compact, to the bit center and the lowest most portion of the surface of the deepest channel to the bit center. The cutting structure height "$h_{cs}$" may be the same or different from the blade height "$h_b$." Suitably, the channel nearest the bit center may be within five adjacent channels on either side of the cutting structure to be measured, more suitably the channel nearest the bit center may be within three adjacent channels on either side of the cutting structure to be measured. In other words, the channel nearest the bit center, used to measure the cutting structure height, may or may not be adjacent the blade 40 for which the cutting structure height is being measured. This distance, cutting structure height "$h_{cs}$", may be measured by determining the difference in length between a reference line drawn from a reference point along the bit axis (50) to the uppermost surface of the cutting structure being measured ($R_{HCS}$ having a length $L_{HCS}$ (not depicted)) and a line drawn from the reference point to the lowest most portion of the surface of the channel nearest the bit center ($R_{LC}$ having a length $L_{LC}$ (not depicted)) (i.e., $h_{cs}=L_{HCS}-L_{LC}$), measured at the same radial distance from the bit axis 50.

As used herein, unless specified otherwise, the term "channel depth" refers to the distance between the lowest most portion of the surface of the channel to the bit center and the uppermost surface of an adjacent blade to the bit center, measured at the same radial distance from the bit axis.

As used herein, unless specified otherwise, the term, "insert height '$h_i$'", refers to the vertical distance, as measured perpendicular to the surface of the blade, between the upper surface of the blade proximate the insert to the uppermost portion of the insert extending above the surface of the blade.

Figure 3:
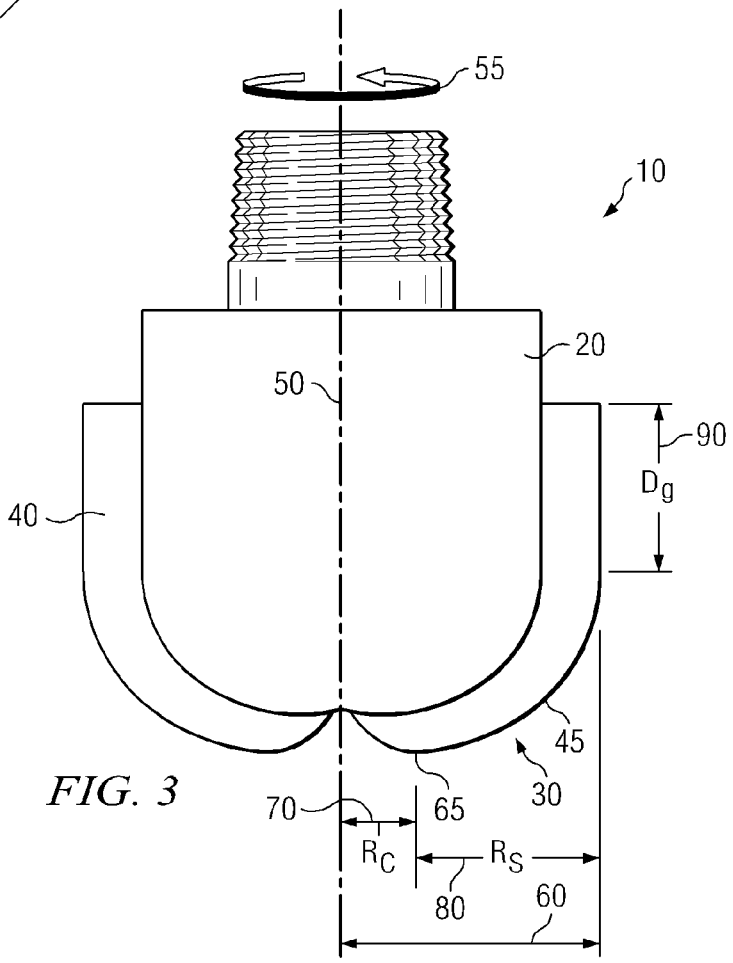
FIG. 3 shows a partial cross-sectional view of an impregnated drill bit according to one or more embodiments of the present disclosure.

As shown in FIG. 3, an impregnated drill bit 10 comprises a bit body 20 having a lower end face (crown) 26 for engaging a rock formation (not shown) and a plurality of blades 40 (only two of which are shown) extending from the bit body 20 at the lower end face (crown) 26. Bit 10 rotates about a central longitudinal axis 50 in a direction indicated by arrow 55. At least one of the blades extends radially from proximate the central longitudinal axis 50 of bit 10 towards the outer bit radius 60 (or diameter), i.e., gage, of bit 10 (i.e., a primary blade). Blade 40 has a cone region 70 which extends from proximate the central axis 50 to the shoulder region 80. Cone region 70 is defined by a radial distance along the x-axis measured from central axis 50. It is to be understood that the x-axis is perpendicular to the central axis 50 and extends radially outward from central axis 50. Cone region 70 may be defined by a percentage of the outer radius 60 of bit 10. In some example embodiments, cone region 70 extends from central axis 50 to no more than 50% of outer radius 60. In some example embodiments, cone region 70 extends from central axis 50 to no more than 30% of the outer radius 60. The outer boundary of cone region 70 may coincide with the distance at which one or more secondary blades may begin. As used herein, a "secondary blade" is a blade that does not extend to proximate the central axis of the bit. The actual radius of cone region 70, measured from central axis 50, may vary from bit to bit depending on a variety of factors including without limitation, bit geometry, bit type, presence and location of one or more secondary blades, or combinations thereof. For instance, in some cases, bit 10 may have a relatively flat parabolic profile resulting in a cone region 70 that is relatively large (e.g., 50% of outer radius 60). However, in other cases, bit 10 may have a relatively long parabolic profile resulting in a relatively smaller cone region 70 (e.g., 30% of outer radius 60). Adjacent cone region 70 is shoulder (or the upturned curve) region 80. In this embodiment, shoulder region 80 is generally convex. The transition between cone region 70 and shoulder region 80 occurs at the axially outermost portion of the blade profile 45 (lowermost point on bit 10 in FIG. 3), which is typically referred to as the nose or nose region 65. Next to the shoulder region 80 is the gage region 90 which extends substantially parallel to central axis 50 at the outer radial periphery of blade profile 45.

Blade 40 has a blade height (not shown). The height of the blade is at least 40 mm. In some example embodiments, the height of the blade may be at least 50 mm. In some example embodiments, the height of the blade may be at least 55 mm. In some example embodiments, the height of the blade may be at least 60 mm, for example 65 mm, 70 mm, 80 mm, or greater. Preferably, the blade height may be the blade height in the cone region, shoulder region, and/or nose region, since the height of a blade in these regions can impact the performance of the bit the most. Depending on the particular application, sometimes the cone region wears more quickly requiring such blade heights; sometimes the nose region wears more quickly, for example when a greater weight on bit (WOB) is applied; and/or sometimes the shoulder region wears more quickly, for example when operating the bit at a greater rate of penetration (ROP).

Suitably, the cone region extends radially from the central axis of the bit to a cone radius $R_c$, shoulder region extends radially from cone radius $R_c$ to shoulder radius $R_s$, and gage region extends axially a distance $D_g$. Although not shown in FIG. 3, one or more of the blades may also have one or more polycrystalline diamond compacts or polycrystalline diamond segments (a polycrystalline diamond construction not having a substrate attached thereto, for example U.S. Pat. No. 7,426,969, which is incorporated herein by reference in its entirety, and which describes an example of such segments) disposed thereon. The diamond may be treated to render at least a portion of the polycrystalline diamond thermally stable, for example by leaching. In some example embodiments, the compacts may be disposed along the leading edge of a blade. In some example embodiments, one or more compacts may be positioned in the cone region of at least one primary blade, in particular a majority of primary blades may have one or more compacts disposed thereon in the cone region, more in particular all the primary blades may have one or more compacts disposed thereon in the cone region.

In an example embodiment, one or more secondary blades may extend significantly into the cone region, in other example embodiments, one or more secondary blades may begin at the cone radius (e.g., cone radius $R_c$) and extend toward gage region. In an example embodiment, one or more of the primary and/or secondary blades may extend substantially to the gage region (outer radius). However, in other example embodiments, one or more of the primary and/or secondary blades may not extend completely to the gage region or outer radius (or outer diameter) of the bit.

Blade profiles 45 may also be described as two regions termed "inner region" and "outer region", where the "inner region" is the central most region of bit 10 and is analogous to cone region 70, and the "outer region" is simply the region(s) of bit 10 outside the inner region. Using this nomenclature, the outer region is analogous to the combined shoulder region 80 and the gage region 90 previously described. The inner region may be defined similarly to cone region 70 (e.g., by a percentage of the outer radius 60, by the starting location of the secondary blades, etc.).

Figure 4:
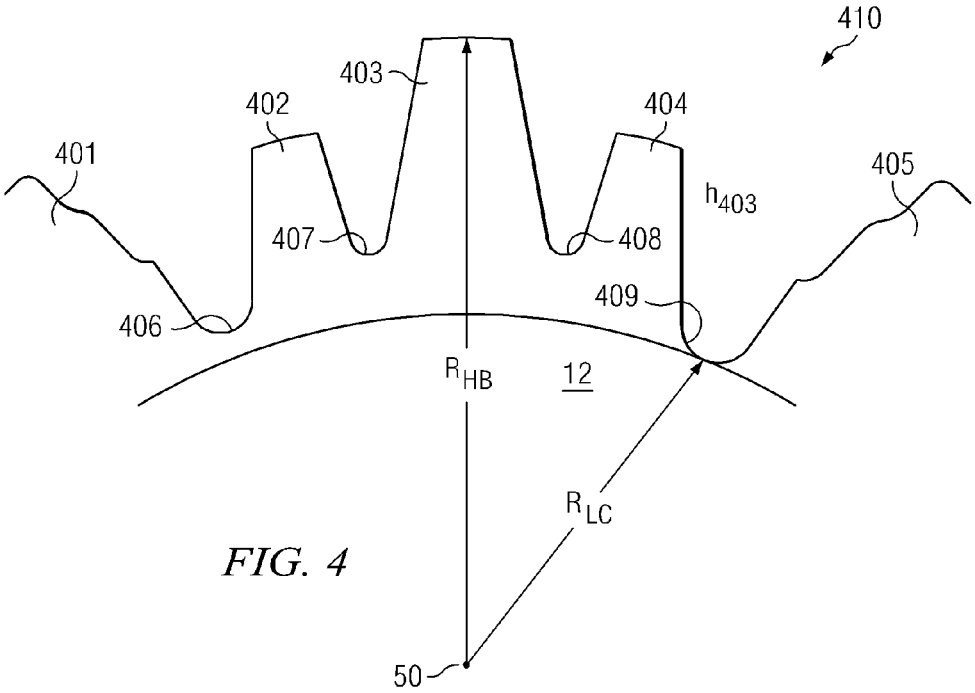
FIG. 4 shows a cross-sectional view of a plurality of blades of a drill bit according to one or more embodiments of the present disclosure.

FIG. 4, shows a partial cross-sectional profile of bit 410. Shown are blades 401-405 and channels 406-409. Channels 406-409 are of different depths. Channel 409 being the deepest, therefore, the channel nearest the bit center. Blade height for blade 403, "$h_{403}$" (not depicted), is measured by determining the difference in length between a reference line drawn from a reference point along the bit axis (50) to the uppermost surface of the blade being measured ($R_{HB}$ having a length $L_{HB}$ (not depicted)) and a line drawn from the reference point to the lowest most portion of the surface of the channel nearest the bit center ($R_{LC}$ having a length $L_{LC}$ (not depicted)) (i.e., $h_{403}=L_{HB}-L_{LC}$), measured at the same radial distance from the bit axis 50.

Figure 5:
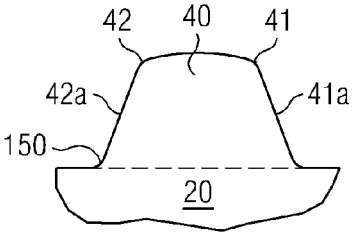
FIG. 5 shows a cross-sectional view of a blade of a drill bit according to one or more embodiments of the present disclosure.

FIG. 5 shows a cross-sectional view of blade 40 viewed perpendicular to the surface of the bit body 20. Blade 40 has a leading edge 41 and a trailing edge 42. Blade 40 also has a leading side 41*a* and a trailing side 42*a*. The leading edge/side and the trailing edge/side are determined by the direction in which the bit rotates in the wellbore. The leading edge/side faces the direction of rotation of the bit whereas the trailing edge/side does not face the direction of rotation. The region where the leading side 41*a* and the trailing side 42*a* intersect with the channel on the surface of the bit body is referred to as the root radius region 150.

Described herein are several embodiments, which may be used alone or in combination with one or more other embodiments, to form an impregnated bit having a tall blade structure. Use of an impregnated bit having a tall blade structure in accordance with one or more embodiments of the present disclosure can provide for an improvement in performance, such as bit durability, ROP and/or cost effectiveness, such as by preventing blade breakage and keeping the ROP within acceptable limits so that the bit does not get pulled from the formation prematurely with significant amounts of blade material remaining.

The blades may be of any suitable shape. For example, in cross-sectional view perpendicular to the bit face, the blade may have a geometric profile that is generally rectangular with a substantially constant width, generally trapezoidal with varying width, generally parabolic, etc. However, a blade having a cross-sectional profile of any geometric configuration may be used. In cross-sectional view perpendicular to the surface of the bit, the blade may be symmetrical or asymmetrical. In some example embodiments, one or more blades may differ in geometry.

Figure 8:
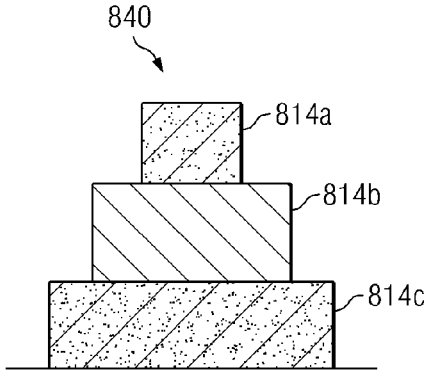
FIG. 8 shows a cross-sectional view of a blade of a drill bit according to one or more embodiments of the present disclosure.

Reference is made to U.S. Patent Application Publication No. 2009/0283334 A1, which is assigned to the present assignee and is incorporated herein by reference in its entirety. In particular, one or more of the blades may vary in width along its height in an incremental (step-wise) or continuous (gradual) manner. FIG. 2 illustrates a blade 240 having a combination of stepped and graded or sloped width variation. Specifically, FIG. 2 is illustrated as having three steps (layer or region) 215*a*, 215*b*, 215*c*, having incremental width changes, with each step 215*a*, 215*b*, and 215*c* also having a gradual variation in its width. The blade may have 2 or more step-wise variations in width "w", for example 3, 4, 5, or 6 or more step-width changes. One skilled in the art would appreciate based on the teachings of the present disclosure that the incremental width differential may depend, for example, on the size of the particular bit, the number of blades on the bit, etc. In some example embodiments, the width differential between steps may range from 0.05 inches to 0.75 inches (1.3 mm to 19 mm). Referring to FIG. 8, a stepped blade 840 includes steps 814*a*, 814*b*, and 814*c*. Steps 814*a*, 814*b*, and 814*c* are all formed of different materials. In some example embodiments, step 814*c* comprises an abrasive particle-free matrix material. However, in an alternative embodiment, steps 814*a*, 814*b*, and 814*c* may be formed of the same material.

Figure 9:
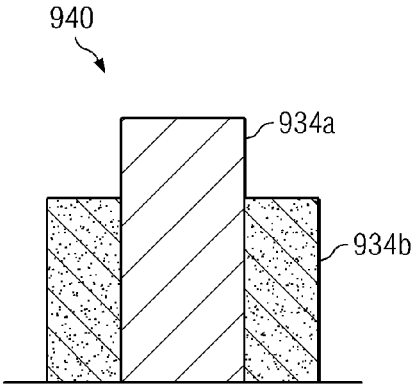
FIG. 9 shows a cross-sectional view of a blade of a drill bit according to one or more embodiments of the present disclosure.

Referring to FIG. 9, a blade 940 may be segmented vertically, such that a center segment 934*a* may have a greater height than neighboring segments 934*b*, such that the width of blade 940 varies along its height. Vertical segments (regions) 934*a* and 934*b* may be of the same material or different materials. Using different materials between the vertical segments, the increased contact area from wear of the blade may be balanced by a blade that then wears in situ to have a tapered surface (back raked blade). Formation of a tapered surface in situ is discussed in greater detail below and in U.S. Patent Application Publication No. 2009/0283335 A1, which is assigned to the present assignee and is incorporated herein by reference in its entirety. It may be desirable to form exterior vertical segments of a softer material, as compared to interior segments, so as to provide for the in situ formation of a taper. Suitably, softer material may be located near the trailing side of the blade. Alternatively or in addition, softer material may be located near the leading side of the blade. In some embodiments, vertical segments of greater height (e.g., vertical segment 934*a*) may contain different abrasive particles from the other vertical segments. In some example embodiments, vertical segments of greater height (e.g., vertical segment 934*a*) may contain abrasive particles of natural diamond and the other vertical segments (e.g., vertical segments 934*b*) may contain abrasive particles of synthetic diamond. Although FIG. 9 illustrates a blade having a total of three vertical segments, one of ordinary skill in the art would appreciate based on the teachings of the present disclosure that the number of vertical segments may vary, and may include an even or an odd number of segments with any number of incremental width differentials and may be symmetric or asymmetric. In some example embodiments, the vertical segments may be of uniform height.

Figure 10:
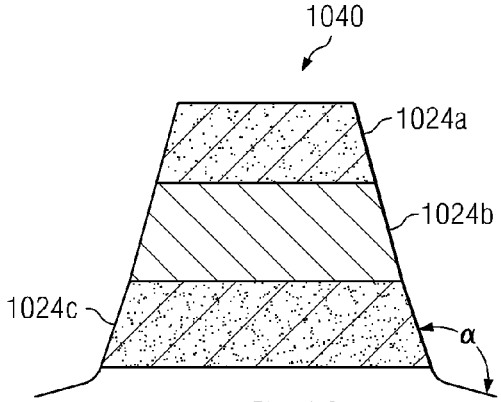
FIG. 10 shows a cross-sectional view of a blade of a drill bit according to one or more embodiments of the present disclosure.

FIG. 10 illustrates blade 1040 having a generally trapezoidal cross-sectional geometric profile with its width varying at a constant rate. Such width variance may be correlated by an angle, a, between the adjacent channel and the side of the blade. Suitably, angle, a, may be greater than 90°, for example in the range of from 95° to 135°. Blade 1040 may be segmented into multiple layers (regions) 1024*a*, 1024*b*, 1024*c*, which may be formed of different materials. The steps and/or vertical segments (regions) may have a uniform composition or may have a non-uniform composition which may provide a gradient or may provide for discrete regions (sub-regions) of different materials. The materials for the blades may be selected to provide a differential in one or more properties, for example wear resistance, hardness, toughness, etc. In some embodiments, the upper most layers (e.g., step 814*a* of FIG. 8; layer 1024*a* of FIG. 10) may contain abrasive particles of natural diamond and the other layers (e.g., step 814*b* of FIG. 8; layer 1024*b* of FIG. 10) may contain abrasive particles of synthetic diamond.

At least a portion of the blades are formed of a matrix material impregnated with a plurality of abrasive particles. The matrix material comprises hard particles and metal binder. The abrasive particles may be any suitable material having a greater abrasion resistance than the hard particles in the surrounding matrix material. The abrasive particles may be selected from synthetic diamond, natural diamond, reclaimed natural or synthetic diamond grit, cubic boron nitride (CBN), thermally stable polycrystalline diamond (TSP), silicon carbide, aluminum oxide, boron carbide, and combinations thereof. As used herein, the term "thermally stable polycrystalline diamond (TSP)" is meant to include polycrystalline diamond materials which are thermally stable at temperatures above 700° C., for example above 1000° C. One way to render polycrystalline diamond material thermally stable is by removing cobalt metal from the interstitial spaces within the diamond lattice structure (e.g., leaching).

In some example embodiments, the drill bit may have one or more blades at a different blade height. The drill bit may have blades at more than two different heights such as 3, 4 or 5 or more different heights. In some example embodiments, one or more of the primary blades may have a greater blade height than one or more of the secondary blades. In some example embodiments, the blades having the greater height may contain a different type or concentration of abrasive particle than the blades having a lesser height, for example different types or concentrations of diamond particles. In some example embodiments, the blades having the greater height may contain natural diamond particles (grit) while the blades having the lesser height may contain synthetic diamond particles (grit) or vice versa, depending on the application.

In some example embodiments, a blade may comprise one or more additional portions (regions) of material which differ with respect to one or more properties. In some example embodiments, one or more blades on a bit may differ in composition from one or more other blades on the bit. In some example embodiments, two different materials may be used to form different portions of a blade. Materials may differ with respect to composition, particle size distribution, hard particle content, abrasive particle content, metal binder content, hardness, erosion resistance, abrasion resistance, and toughness. Utilizing different materials for different regions of a blade can improve the performance of the bit especially when drilling through mixed formation types. The different portions of the blade which contain different materials may vary axially and/or radially along the blade.

In one or more embodiments, at least one blade may have at least a first region and a second region comprised of different materials, for example two different impregnated matrix materials with one of the materials having a greater wear resistance as compared to the other. In some example embodiments, at least one blade has a length extending radially along the bit face from a first end to a second end, which blade has a plurality of first regions disposed along an edge of the blade, for example the leading edge or the trailing edge. In some example embodiments, the blade may additionally have a plurality of second regions also disposed along an edge of the blade. The second regions may alternate with the plurality of first regions. The first region and/or second region may span a portion of the blade width and height or may span (traverse) the entire width and/or height of the blade. In some example embodiments, a first plurality of first regions may be disposed on a blade and a second plurality of first regions may be disposed on another blade being staggered in a radial direction (along the length of the blade) with respect to the first plurality of first regions. In an example embodiment, a first plurality of second regions may be disposed on the blade containing the first plurality of first regions in an alternating manner and a second plurality of second regions may be disposed on the blade containing the second plurality of first regions. The first plurality of second regions may be staggered in a radial direction (along the length of the blade) with respect to the first plurality of second regions. One skilled in the art would appreciate based on the teachings of the present disclosure that more than two regions with different materials may be used depending on the application. For more detailed description of using at least two different materials to form a blade, reference is made to U.S. Pat. No. 6,095,265 and U.S. Patent Application Publication Nos. 2009/0283334 A1, 2009/0283335 A1, and 2009/0283336 A1, which are assigned to the present assignee and are incorporated herein by reference in their entirety.

In one or more embodiments, a portion of the gage region may be formed using an impregnated matrix material that is unique as compared to the other materials used in the remaining portions of the blades and bit body. Because the improved blades of the present disclosure can allow for improved bit durability, one skilled in the art would appreciate based on the teachings of the present disclosure that it may be desired that the gage region may comprise a very hard material to maintain gage while the bit is in operation (i.e., the borehole is not undergage due to significant wear of the gage region). In a particular embodiment, a unique diamond impregnated material may be tailored to have a material composition harder than the remaining portions of the blades and bit body. The hardness of the impregnated material may be varied by altering the amount, type, size, etc. of the hard particles, binder and/or the abrasive particles. In a particular embodiment, the unique diamond impregnated material may have a diamond concentration of more than 100 (for example at least 110 or at least 120) with the rest of the bit having a diamond concentration of at most 100 (100=4.4 carat/cm$^3$). The unique diamond impregnated material may extend into the shoulder region. The unique diamond impregnated material may be positioned along the surface of the blade a select distance (2.5 mm to 15 mm) into the blade. Formation of such a gage region is discussed in greater detail in pending U.S. Patent Application Publication No. 2009/0283336 A1, which is assigned to the present assignee and is incorporated herein by reference in its entirety.

In one or more embodiments, the material used to form the bit in at least a portion of the blade root region may be free (devoid) of abrasive particles. Such region is suitably radiused and referred to herein as a root radius region. Suitably, the surface along the entire root radius region may comprise a layer free of abrasive particles. In some example embodiments, the layer of matrix material adjacent the surface in the root radius region may have a greater toughness as compared to the adjacent bit body material. The root radius region is meant to include the area where the blade transitions to an adjacent channel. The root radius region begins at the point where a line drawn tangent to the side of the blade intersects the base (root) of the blade and may end at the point where a line drawn tangent to the side of the channel intersects the base (root) of the blade. In other words, the root radius region comprises the transitional radius surface between the blade and the adjacent channel.

Figure 11:
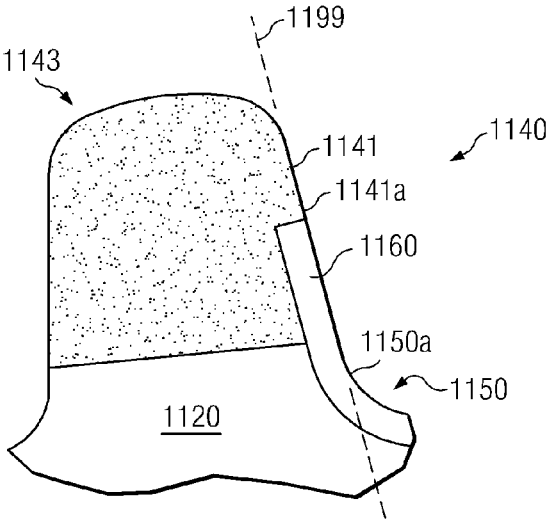
FIG. 11 shows a cross-sectional view of a blade of a drill bit according to one or more embodiments of the present disclosure.

In one or more embodiments, at least a portion of the face of the leading and/or trailing side of the blade may be formed of a layer comprising an abrasive particle free matrix material (i.e., a matrix material devoid of abrasive particles). In some example embodiments, a matrix material in the root radius region adjacent the leading side of the blade may be different from a matrix material in the root radius region adjacent the trailing side of the blade and both may be different from the matrix material used to form the adjacent portion of the bit body. The layer may extend from the side of the blade a selected distance above the root radius region into the root radius region. In some example embodiments, the layer may extend along the entire surface of a side of the blade and extend through the entire root radius region. As shown in FIG. 11 (a partial cross-sectional view of a drill bit), blade 1140 is adjacent bit body 1120. Blade 1140 has a leading edge 1141, a leading side 1141*a* and a root radius region 1150. Root radius region 1150 begins at point 1150*a* where reference line 1199, drawn tangent to the leading side 1141*a* of the blade, intersects the base or root of the blade. Blade 1140 has a region 1143 comprising an impregnated matrix material and a region or layer 1160 forming a portion of the face of the leading side 1141*a* and extending along the root radius region 1150. Layer 1160 is composed of a material which is free of abrasive particles. The material may be a metal or a matrix material. The metal may be any suitable metal, such as a metal selected from titanium, zirconium, vanadium, niobium, tantalum, chromium, molybdenum, tungsten, iron, cobalt, nickel, copper, mixtures and alloys thereof, in particular a mixture comprising tungsten and nickel powders. The matrix material which may be used for layer 1160 may be any suitable matrix material, such as the matrix materials described herein.

In some example embodiments, the matrix material of layer 1160 may be different from the matrix material used to form the bit body adjacent blade 1140. In some example embodiments, the matrix material of layer 1160 may be the same as the matrix material of bit body 1120 adjacent the blade. In some example embodiments, the matrix material of layer 1160 may be different from the matrix material used to form the blade adjacent layer 1160. In some example embodiments, the matrix material of layer 1160 may be the same as the matrix material used to form the blade adjacent layer 1160.

In some example embodiments, the matrix material for layer 1160 may have a greater toughness and/or strength (also referred to as transverse rupture strength) than that typically used to form an impregnated blade. This can maximize the strength and/or toughness of the blade. A first example of such materials is described in U.S. Pat. No. 6,287,360, which description is incorporated by reference herein, and which describes a matrix material comprising hard particles which comprise large-grain carburized tungsten carbide and an additional metal binder. The additional metal binder may be selected from Group VIIIB metals of the Periodic Table (CAS version of the periodic table in the CRC Handbook of Chemistry and Physics) such as nickel, cobalt, iron, mixtures and alloys thereof. The hard particles may comprise large-grain (a substantial percentage, i.e., fifty percent or more, of the grains or particles are greater than 10 microns in size) carburized tungsten carbide and cast tungsten carbide. The matrix material may also contain an additional metal binder such as a nickel powder. Such additional metal binder may be any suitable size. Such metal powder may have an average particle size in the range of 35 to 55 microns. For example, the matrix material may comprise 40 to 70% by weight (% w) (e.g., about 62% w) large-grain carburized tungsten carbide, 20 to 55% w (e.g., about 30% w) cast tungsten carbide, and 2 to 15% w (e.g., about 8% w) nickel and/or iron, based on the total weight of the powder to be infiltrated with a metal binder (infiltrated metal binder). The large-grain carburized tungsten carbide may have an average grain size in the range of from 20 to 125 microns. Of course, grain sizes greater than 125 microns may also be acceptable. The average particle size is a Fisher Sub-Sieve Size (FSSS) value. An FSSS value of a powder may be obtained by the method as set forth in ASTM B330-88. An FSSS value indicates that a major portion of the measured particles fall within the range of that value.

A second example of a matrix material for layer 1160 is described in U.S. Pat. No. 7,250,069, which description is incorporated by reference herein, and which describes a matrix material comprising hard particles which comprise spherical sintered tungsten carbide and an additional metal binder. The additional metal binder may be selected from Group VIIIB metals of the Periodic Table such as nickel, cobalt, iron, mixtures and alloys thereof. The spherical sintered tungsten carbide may have an average particle size in the range of from 0.2 to 20 microns, in particular from 1 to 5 microns. The hard particles may also comprise cast tungsten carbide and monotungsten carbide. The matrix material may also contain an additional metal binder such as a nickel or iron powder. Such metal powder may be of any suitable size. Such metal powder may have an average particle size in the range of from 5 to 55 microns such as a nickel powder having an average particle size in the range of from 5 to 25 microns. For example, the matrix material may comprise 45 to 70% by weight (% w) spherical sintered tungsten carbide, 5 to 30% w cast tungsten carbide, 5 to 40% w carburized tungsten carbide, and 10 to 25% w metal powder (e.g., nickel), based on the total weight of the powder to be infiltrated with a metal binder (infiltrated metal binder). Additionally, although not disclosed in U.S. Pat. No. 7,250,069, the matrix material may comprise 25 to 50% by weight (% w) spherical sintered tungsten carbide, 20 to 55% w cast tungsten carbide, 5 to 40% w carburized tungsten carbide, and 2 to 15% w metal powder (e.g., nickel), based on the total weight of the powder to be infiltrated with a metal binder.

A third example of a matrix material for layer 1160 is described in US Patent Application Publication No. 2007/0175669, which description is incorporated by reference herein, and which describes a matrix material comprising hard particles which comprise monotungsten carbide, sintered tungsten carbide, and cast tungsten carbide particles and an additional metal binder. The additional metal binder may be selected from Group VIIIB metals of the Periodic Table such as nickel, cobalt, iron, mixtures and alloys thereof. The additional metal binder may be present in an amount in the range of from 2 to 15% w, based on the total weight of the matrix material. The quantity of each tungsten carbide may be selected such that after formation the matrix material has an erosion rate of less than 0.001 in/hr, a toughness of greater than 20 ksi($in^{05}$), and a transverse rupture strength of greater than 140 ksi. Methods of measuring erosion, transverse rupture strength and toughness are described in US 2007/0175669 see paragraphs 46-49, which are incorporated herein by reference. The monotungsten carbide may contain particles having a mesh size between 325 mesh and 625 mesh (−325/+625 mesh) (20 to 44 microns). The sintered tungsten carbide may contain particles having a mesh size between 170 mesh and 625 mesh (−170/+625 mesh) (20 to 88 microns). The cast tungsten carbide may contain particles having a mesh size between 60 mesh and 325 mesh (−60/+325 mesh) (44 to 250 microns). The hard particles may be spherical or non-spherical. The matrix material may also contain a metal powder such as a nickel or iron powder. For example, the matrix material may comprise at most 30% w (e.g., from 22 to 28% w) monotungsten carbide, at most 40% w (e.g., from 22 to 28% w) sintered tungsten carbide, and up to 60% w (e.g., from 44 to 56% w) cast tungsten carbide, and optionally at most 12% w additional metal binder (e.g., nickel), based on the total weight of the powder to be infiltrated with a metal binder (infiltrated metal binder).

In one or more embodiments, the first and third example matrix materials for layer 1160, as discussed above, may also be used to form an encapsulating shell on the abrasive particles (e.g., diamond) used to form the bit, for example the blade. Such encapsulated abrasive particles are discussed hereinafter.

Although layer 1160 has been depicted as forming only a portion of the face of the leading side of blade 1140, layer 1160 may extend along the majority of the leading side, suitably the entire height of the leading side. Layer 1160 may be of any suitable thickness. The thickness of layer 1160 may be substantially constant or may vary. The thickness of layer 1160 may be at least 0.01 inches (0.25 mm), for example at least 0.0625 inches (1.6 mm), or at least 0.125 inches (3.2 mm). The thickness of layer 1160 may be at most 0.3 inches (8 mm), for example at most 0.25 inches (6 mm), or at most 0.2 inches (5 mm). A common failure mode of a bit is blade breakage due to crack initiation in the root radius region adjacent to a side of the blade, especially the leading side of the blade. By providing a thin layer of material in at least the root radius region, an improved impregnated drill bit can be provided since the thin layer can reduce crack initiation. Further, providing a thin layer of material along the leading side of a blade can provide an improved surface for attaching polycrystalline diamond segments, such as TSP segments and can also provide for an improvement in performance of the blade.

In some example embodiments, two or more regions of the blade may contain abrasive particles selected to differ in type (i.e., chemical composition), quality, size, concentration, and/or retention coatings, all of which may alter the resulting material properties of the respective portions of the blade. The abrasive particles may be chosen based on the particular application.

The amount of abrasive particles (e.g., diamond) present in the regions of the impregnated blade material may be in the range of from 40 to 140 (100=4.4 carat/$cm^3$), for example 50, 60, 75, 80, 85, 100, 110, 120, or 130. A diamond concentration of 120 is equivalent to 30 percent by volume (% v) of diamond. In an example embodiment, an abrasive particle (e.g., diamond) concentration in the range of from 80 to 125 may be used for at least a portion of a blade having a blade height of at least 40 mm. In an example embodiment, an abrasive particle (e.g., diamond) concentration in the range of from 50 to 100 may be used for at least a portion of a blade having a blade height of at least 60 mm.

In some example embodiments, at least one blade comprises a matrix material containing abrasive particles (e.g., diamond particles) having a contiguity of 20% or less, in particular 15% or less, for example 10% or less. Contiguity of diamond particles or mean free path is described in more detail in U.S. Pat. No. 7,350,599, which description is incorporated herein by reference in its entirety. The relative distribution of abrasive particles (i.e., diamond particles) may be measured using several different methods. First, the distribution may be discussed in terms of diamond "contiguity," which is a measure of the number of diamonds that are in direct contact with another diamond. Ideally, if complete distribution existed, the diamond to diamond contiguity would be 0% (i.e., no two diamonds are in direct contact). By contrast, if half of the diamond particles were in contact with other diamonds, the diamond to diamond contiguity would be 50%.

The diamond contiguity may be determined as follows: $C_{D\text{-}D}=(2P_{D\text{-}D})/2P_{D\text{-}D}+P_{D\text{-}M})$ where $P_{D\text{-}D}$ equals the total number of contiguous points of diamond along the horizontal lines of a grid placed over a sample photo, and $P_{D\text{-}M}$ equals the total number of points where diamonds contact matrix.

Contiguity of diamond particles may be obtained by uniformly distributing the diamond particles throughout the matrix material. Use of encapsulated diamond particles, discussed in more detail hereinafter, is but one way to achieve such contiguity values. The contiguity values may also be accomplished by achieving a good distribution of diamond particles within the matrix powder (i.e., hard particles and optionally metal powder).

The matrix material selected may depend on the desired properties which can be obtained by varying one or more of hard particle (e.g., metal carbide) size, hard particle content, metal binder content, metal binder type, abrasive particle (e.g., diamond) size, abrasive particle spacing (i.e., contiguity), and abrasive particle (e.g., diamond) concentration.

The size and shape of the abrasive particles may also be varied. For example, abrasive particles may be in the shape of spheres, cubes, irregular shapes, or other shapes. In some example embodiments, abrasive particles may range in size from 0.2 to 3.5 mm in length or diameter; suitably from 0.3 to 2 mm; in particular from 0.4 to 1.5 mm; for example from 0.5 to 1.0 mm. However, particle sizes are often measured in a range of mesh sizes, for example abrasive particles may include particles not larger than would be filtered by a screen of 10 mesh. In other embodiments, abrasive particles may range in size from −15+35 mesh. The particle sizes and distribution of the particle sizes of the abrasive particles may be selected to allow for a broad or narrow and mono-, bi-, tri- or multi-modal distribution. However, for some applications, size ranges outside those discussed above may also be selected. Further, although particle sizes or particle diameters are referred to, it is understood by those skilled in the art that the particles may not necessarily be exactly spherical in shape but may contain corners, sharp edges, and angular projections. The diameter or length of a particle being determined based on the maximum length or diameter of the particle if it is not spherical.

Further, as discussed above, the various abrasive particles that may be selected for use in the blades may vary in type (i.e., chemical composition) such that the various portions of a blade may use different types of abrasive particles; however, one of ordinary skill in the art would appreciate that among these abrasive particles, there may also be a difference in compressive strength of the particles. For example, some synthetic diamond grit may have a greater compressive strength than natural diamond grit and/or reclaimed grit. Furthermore, even within the general synthetic grit type, there may exist different grades of grit having differing compressive strengths, such as those grades of grit commercially available from Element Six Ltd. (Berkshire, England). For example, recycled diamond grit (reduced strength due to multiple high temperature exposures) could be used as the abrasive particles within the blade so as to render that portion less wear resistant than another portion.

In addition to varying the strength of the abrasive particles, in an exemplary embodiment, the abrasive particles may be surrounded by an exterior encapsulating shell of matrix material. Such encapsulated particles are described, for example, in U.S. Pat. No. 7,350,599 and U.S. Patent Publication Nos. 2008/0017421, 2008/0282618, and 2009/0120008, all of which are assigned to the present assignee, and herein incorporated by reference in their entireties. Additional descriptions may be found, for example, in WO 2009/010934 A2, WO 2008/142657 A1 and U.S. Patent Application Publication Nos. 2010/0062253 A1 and 2007/0160830 A1, which descriptions are herein incorporated by reference in their entireties. Encapsulated particles may be formed by encapsulating or surrounding abrasive granules (particles), which may or may not have a retention coating applied thereon (see the description below), with a matrix material using encapsulation techniques known to one skilled in the art. The matrix material used to form the encapsulating shell may comprise a metal carbide, as discussed herein. Suitably, the metal carbide may include at least one of macrocrystalline tungsten carbide, carburized tungsten carbide, cast tungsten carbide, and sintered tungsten carbide. The metal carbide may be provided in the form of particles which may be spherical or crushed in shape. The matrix material may also include a metal binder. The metal binder may be selected from cobalt, nickel, iron, chromium, copper, molybdenum, other transition metal elements, their alloys and mixtures thereof. One skilled in the art would appreciate based on the teachings of the present disclosure that the matrix material hard particles and metal binder may be provided from the encapsulating shell applied to the abrasive particles. The particles used to form the encapsulating shell may have particle sizes in the range of from about 1 to 200 micrometers, suitably from about 1 to 150 micrometers, more suitably from 10 to 100 micrometers, for example less than 75, 50, 15, 10, or 3 micrometers. The particles used to form the shell may have a particle size distribution that is broad or narrow and mono, bi-, tri- or otherwise multi-modal.

The encapsulating shell may have any thickness. Desirable thicknesses may vary depending on the application (e.g., the amount of abrasive particles and matrix material desired). The average thickness of the encapsulating shell may vary depending on the sizes of the abrasive granules used in forming the encapsulated abrasive particles. In some embodiments, an encapsulating shell may have an average thickness ranging from 0.05 mm to 1.5 mm, suitably from 0.1 mm to 1.3 mm; for example from 0.15 mm to 1.1 mm and from 0.2 mm to 1 mm. Suitably, an encapsulating shell may have an average thickness ranging from 750 micrometers to 1000 micrometers. The encapsulating shell may have a substantially uniform thickness. Alternatively, the encapsulating shell may have a varying thickness. The concentration of abrasive particles (e.g., diamond concentration) may be varied, for example, by altering the thickness of the encapsulating shell. The encapsulating shells may also comprise different matrix materials which may wear at different rates thereby exposing the abrasive particles at different rates for example cast tungsten carbide and carburized tungsten carbide. A benefit to using different matrix materials in the shells is that a certain percentage of the diamonds can be kept sharp and cutting at all times, therefore, maintaining at least a modest ROP. If the ROP slows down too severely due to diamonds not wearing away fast enough to expose new diamonds, the bit is pulled prematurely with plenty of blade height remaining which is very costly.

In an exemplary embodiment, the abrasive granules (particles) may have a retention coating applied to the surface of the granules. The retention coating may comprise a metal carbide, such as tungsten carbide, silicon carbide, titanium carbide, molybdenum carbide, chromium carbide, and combinations thereof. Abrasive particles containing such a retention coating are described, for example, in U.S. Patent Publication No. 2005/0230150, which is assigned to the present assignee, and herein incorporated by reference in its entirety. The coated particles may or may not be further encapsulated with a matrix material. In some example embodiments, the presence and identity of the retention coating on the surface of the abrasive granule may be varied. Such retention coatings may be applied by conventional techniques such as CVD (chemical vapor deposition) or PVD (physical vapor deposition). The retention coating (having a thickness of only a few micrometers) may be more helpful for high temperature protection (e.g., silicon carbide (SiC) coatings) while others are helpful for particle retention (e.g., titanium carbide (TiC)). In an exemplary embodiment, at least the surface of a blade may comprise abrasive particles formed starting with a synthetic diamond grit having a mesh size of −20/+25 mesh (707 to 841 microns) or −25/+35 mesh (500 to 707 microns). For example, SDB1100, which is a strong grit (−25/+35 mesh) commercially available from Element Six Ltd., which is coated with a TiC coating applied by a CVD coating process and then encapsulated with a material comprising 70% by volume (% v) of tungsten carbide (WC) and the balance a binder mixture of cobalt and copper. In some example embodiments, at least two different coated and/or encapsulated abrasive particles may be utilized to form a particular region forming at least a portion of a blade. Different coated and/or encapsulated abrasive particles may be used to form different regions (portions) of the blades. One of ordinary skill in the art would appreciate based on the teachings of the present disclosure that the composition and amounts may be varied depending on the particular application. It is to be understood that the concentration of abrasive particles (e.g., diamond) is to be calculated based on the abrasive granules and does not include any retention coating or encapsulating shell that may be present surrounding the abrasive granules or particles.

Figure 12:
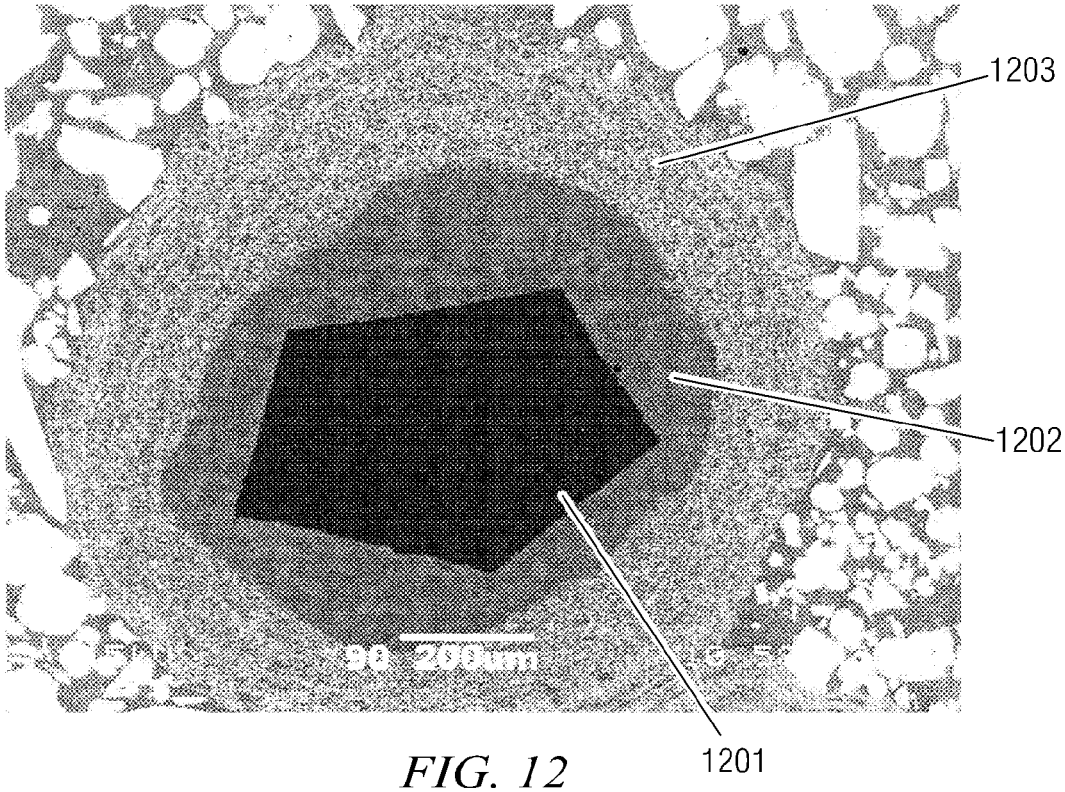
FIG. 12 shows a SEM image of an abrasive particle according to one or more embodiments of the present disclosure.

At least a portion of at least one blade comprises a region containing abrasive particles dispersed in a continuous matrix material formed from matrix hard particles and a metal binder material, such as an infiltrating metal binder material. For example, the matrix material may include a mixture of a metal carbide and a metal binder alloy. In an example embodiment, the matrix powder material may include hard particles of at least one of macrocrystalline tungsten carbide particles, carburized tungsten carbide particles, cast tungsten carbide particles, and sintered tungsten carbide particles. Additionally, non-tungsten metal carbides of vanadium, chromium, titanium, tantalum, niobium, and other carbides of the transition metal group may be used as hard particles. Carbides, oxides, and nitrides of Group IVA, VA, or VIA metals (CAS version of the periodic table in the CRC Handbook of Chemistry and Physics) may also be used as hard particles. In some example embodiments of the present disclosure, hard particles may be used in combination with a powder metal binder such as cobalt, nickel, iron, chromium, copper, molybdenum, alloys, and combinations thereof and the mixture may be subsequently infiltrated. The powder metal binder may be a heat treatable metal binder, i.e., the properties of the matrix material improve after a subsequent heat treatment following infiltration. In some example embodiments, a matrix material used to form at least a portion of the blades may contain a powder metal binder different from the infiltrating metal binder material, in particular a powder metal binder having a lower melting temperature than the infiltrating metal binder. Suitable metal powder binders may include, for example, Cu, Co, and Cu—Mn, Cu—P, Cu—Sn, Cu—Zn, Cu—Ag, Ni—Cr—Si—B alloys, super alloys (such as Ni-based, Co-based, and Fe—Ni-based super alloys), and combinations thereof. Additionally, different powder metal binders may be used for different regions of the blade, for example the softest, lowest melting temperature, powder metal binder may be used to form a region on an upper surface of the blade which extends a distance into the blade. Adjacent this region within the blade, a different powder metal binder may be used which has intermediate properties in hardness and melting temperature as compared to the powder metal binder used in the adjacent region on the upper surface and the infiltrating metal binder used to form the bit. More than two powder metal binders may be used in different regions depending on the application. In other embodiments, different powder metal binders may be used for different blades, for example the softest, lowest melting temperature, powder metal binder may be used to form one or more blades with a narrow width, for example a primary blade, and a different powder metal binder which has intermediate properties in hardness and melting temperature may be used to form one or more different blades having a greater width, for example a secondary blade. In some example embodiments, instead of using a powder metal binder, a shell of metal binder may be applied to the hard particles and/or abrasive particles used to form the matrix material. When using encapsulated and/or coated abrasive particles, the shell of metal binder may be applied on the exterior of the encapsulating shell, or the coating, or the abrasive granule. FIG. 12 shows a SEM (scanning electron microscope) image of a diamond granule 1201 with a shell of metal binder 1202 (e.g., cobalt) adjacent the diamond granule surface and a shell of metal carbide 1203 comprising mono-tungsten carbide with an average particle size of about 1 micron forming the outer surface adjacent the shell of metal binder. Without wishing to be bound by any particular theory, it is believed that metal shell 1202 can absorb a portion of the forces experienced during operation of the bit which may reduce crack initiation and propagation within the blade. Any suitable metal carbide may be used depending on the desired wear resistance (e.g., abrasion, erosion and/or corrosion resistance) for a particular application.

Figure 13:
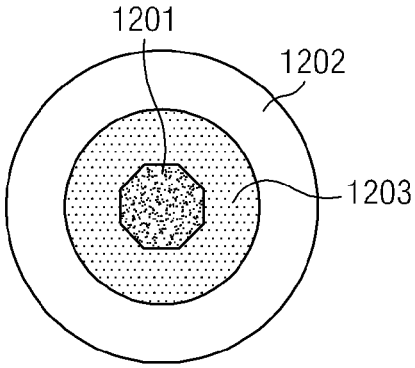
FIG. 13 shows an abrasive particle according to one or more embodiments of the present disclosure.

FIG. 13 depicts a diamond granule 1201 with a shell of metal carbide 1203 (e.g., monotungsten carbide) adjacent the diamond granule surface and a shell of metal binder 1202 (e.g., cobalt) forming the outer surface adjacent the shell of metal carbide. The amount of additional metal binder added to the matrix material (whether in the powder or shell form) may be at least 5% w, for example in the range of from 10% w to 50% w, such as 15% w, 20% w, 25% w, 30% w, 35% w, 40% w, or 45% w. When using a powder metal binder, the powder may have particles having sizes in the range of from 100 mesh to 600 mesh (−100/+600 mesh), in particular from 200 mesh to 325 mesh (−200/+325 mesh). Tall bladed impregnated drill bits according to this embodiment can exhibit improved performance (e.g., ROP and/or durability) from using multiple metal binders in a tailored fashion. In particular, tailoring the metal binder in the blades through the use of lower melting temperature metal binders as compared to the infiltrating metal binder can reduce the liquid reaction with the abrasive particles (e.g., reduce surface graphitization of diamond) from shorter infiltration times and lower temperatures as compared to using an infiltration metal binder alone and can result in an improvement in strength and toughness of a blade.

The infiltrating metal binder material may include a Cu—Mn—Ni—Zn—Sn alloy, Cu—Mn—Ni—Sn—Zn—Fe alloy, Cu—Mn—Ni—Zn—Fe—Si—B—Pb—Sn alloy, Cu—Mn—Ni alloy, Ni—Cr—Si—B—Al—C alloy, Ni—Al alloy, and/or Cu—P alloy. The infiltrating metal binder may be a heat treatable metal binder, i.e., the properties of the matrix material improve after a subsequent heat treatment following infiltration. The matrix material may include hard particles in amounts ranging from 5 to 70% by weight and metal binder in an amount ranging from 30 to 95% by weight thereof to facilitate bonding of matrix hard particles and abrasive particles. Temporary binders such as solvents, organic waxes, adhesive materials, plasticizers, etc. may be used to aid in manufacturing. Further, with respect to particle sizes, the matrix hard particles may be individually selected from particle sizes that may range from about 1 to 200 micrometers, suitably from about 1 to 150 micrometers, in particular from about 10 to 100 micrometers, for example from about 5 to 75 micrometers. In some example embodiments, the matrix hard particles may be less than 50, 10, or 3 microns. The matrix hard particles may have a broad or narrow and mono, bi- or otherwise multi-modal distribution. The hard particles may be in the form of crushed particles or spherical particles (i.e., pellets). The term "spherical", as used herein and throughout the present disclosure, means any particle having a generally spherical shape and may not be true spheres, but lack the corners, sharp edges, and angular projections commonly found in crushed and other non-spherical particles. The term, "crushed", as used herein in the present disclosure, means any particle having corners, sharp edges and angular projections commonly found in non-spherical particles.

An example of an infiltrating metal binder is described in U.S. Pat. No. 5,662,183, which description is incorporated by reference herein, and which describes an infiltrating metal binder comprising a metal selected from cobalt, iron, and nickel, for example an alloy which has a composition of nickel (60 to 81% w) alloyed with 8 to 12% w cobalt, 5 to 10% w chromium, up to 3% w aluminum and about 1% w boron. The alloy may additionally contain up to 5% w silicon, up to 5% w carbon, and trace amounts of manganese, and iron. The binder may also contain up to 25% w refractory metal comprising titanium, zirconium, hafnium, vanadium, niobium, tantalum, chromium, molybdenum, tungsten and combinations thereof.

Another example of an infiltrating metal binder is described in U.S. Pat. Nos. 6,461,401 and 6,375,706, which descriptions are incorporated by reference herein, and which describe an infiltrating metal binder alloy comprising copper in the range of from 24 to 96% w (e.g., 57% w), nickel in the range of from 0 to 15% w (e.g., 10% w), manganese in the range of from 0 to 25% w (e.g., 23% w), zinc in the range of from 3 to 20% w (e.g., 4% w), and tin in the range of from more than 1% w to 10% w (e.g., 6% w). Additionally, cobalt may also be substituted for a portion of the copper, for example in the range of 0 to 6% w (e.g., 2 to 3% w).

Tungsten carbide is a chemical compound containing both the transition metal tungsten and carbon. This material is known in the art to have extremely high hardness, high compressive strength and high wear resistance which makes it ideal for use in high stress applications. Its extreme hardness makes it useful in the manufacture of cutting tools, abrasives and bearings, as a cheaper and more heat-resistant alternative to diamond. Sintered tungsten carbide, also known as cemented tungsten carbide, refers to a material formed by mixing particles of tungsten carbide, typically monotungsten carbide, and particles of cobalt or other iron group metal, and sintering the mixture. In a typical process for making sintered tungsten carbide, small tungsten carbide particles, e.g., 1-15 micrometers, and cobalt particles are vigorously mixed with a small amount of organic wax which serves as a temporary binder. An organic solvent may be used to promote uniform mixing. The mixture may be prepared for sintering by either of two techniques: it may be pressed into solid bodies often referred to as green compacts; alternatively, it may be formed into granules or pellets such as by pressing through a screen, or tumbling and then screened to obtain more or less uniform pellet size. Such green compacts or pellets are then heated in a vacuum furnace to first evaporate the wax and then to a temperature near the melting temperature of cobalt (or the like) to cause the tungsten carbide particles to be bonded together by the metallic phase. After sintering, the compacts are crushed and screened for the desired particle size. Similarly, the sintered pellets, which tend to bond together during sintering, are crushed to break them apart. These are also screened to obtain a desired particle size. The crushed sintered carbide is generally more angular than the pellets, which tend to be rounded.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting temperature into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. The cast tungsten carbide may comprise from about 3.7 to about 4.2 weight percent carbon.

Another type of tungsten carbide is monotungsten carbide. One type of monotungsten carbide is macro-crystalline tungsten carbide. This material is essentially stoichiometric WC. Most of the macro-crystalline tungsten carbide is in the form of single crystals, but some bicrystals of WC may also form in larger particles. Single crystal monotungsten carbide is commercially available from Kennametal, Inc., Fallon, Nev.

Carburized carbide is yet another type of monotungsten carbide. Carburized tungsten carbide is a product of the solid-state diffusion of carbon into tungsten metal at high temperatures in a protective atmosphere. Sometimes it is referred to as fully carburized tungsten carbide. Such carburized tungsten carbide grains usually are multi-crystalline, i.e., they are composed of WC agglomerates. The agglomerates form grains that are larger than the individual WC crystals. These large grains make it possible for a metal infiltrant or an infiltration binder to infiltrate a powder of such large grains. On the other hand, fine grain powders, e.g., grains less than 5 μm, do not necessarily infiltrate satisfactorily. Typical carburized tungsten carbide contains a minimum of 99.8% by weight of WC, with total carbon content in the range of about 6.08% to about 6.18% by weight.

Of the types of carbides described above, one skilled in the art would appreciate based on the teachings of the present disclosure that any combination of particular carbides may be selected for use as a matrix material, depending on the desired resulting properties and application of the bit.

The bit body may be formed of steel and/or a continuous matrix material formed from matrix hard particles and an infiltrating metal binder material. The continuous matrix material for the bit body may be the same as discussed above. The continuous matrix material of the bit body may be the same as used for the blade or may be different. In some example embodiments, the matrix material for the bit body may have a greater toughness and lower erosion and abrasion resistance compared to the matrix material for the blades. In some example embodiments, the matrix material of the bit body may have abrasive particles dispersed therein. In some example embodiments, the bit body has a lower content of abrasive particles as compared to the blades. One or more matrix materials may be used to form the bit body depending on the particular application. The material used to form the bit body and the blades may be chosen based on the desired mechanical properties and/or rate of infiltration. A greater rate of infiltration reduces the time period the bit is exposed to the elevated infiltration temperatures, thus, protecting the abrasive particles (e.g., diamonds). Taller blades can take longer to infiltrate so a bit body and optionally blade material which has a greater rate of infiltration can help to protect the abrasive particles (e.g., diamonds) from temperature degradation. The rate of infiltration may be varied by adjusting the particle size distribution of the powders to be infiltrated since controlling the particle size controls the spacing between particles which in turn controls the capillary force of infiltration.

In one or more embodiments, at least one blade comprises at least one insert. Preferably, a plurality of blades, for example all of the blades, contain a plurality of inserts in at least the shoulder region. The inserts are embedded within the blade. The total length of the insert, which is meant to include the total length of multiple insert segments when they are attached together to form an insert, may be more than 30 mm, at least 40 mm, or at least 60 mm. The insert may contain hard particles and a metal binder. The hard particles may be chosen from the hard particles described above for the blade matrix material. The metal binder may also be chosen from the metal binder materials described above for the blade matrix material. The hard particles and metal binder may be formed into an insert by subjecting the materials to sufficient temperature and pressure conditions to bind the particles together. The insert may also contain abrasive particles as described above. One type of such abrasive containing inserts may be referred to as grit hot pressed inserts (GHIs). In some embodiment, the inserts may have different properties from the blade material. For example, the abrasive particle concentration of the insert may differ from the abrasive particle concentration of the blade. In some example embodiments, the abrasive particle (e.g., diamond) concentration of the insert may be greater than the abrasive particle concentration of the blade material proximate the insert. The amount of abrasive particles (e.g., diamond) present in the insert may be in the range of from 85 to 120 (100-4.4 carat/$cm^3$), in particular 100 to 110 concentration. In some embodiments, more than one type of abrasive particle may be used to form an insert and/or blade. For example, encapsulated and non-encapsulated particles may be combined and used and/or coated and uncoated particles may be combined and used. In some example embodiments, the abrasive particles used in the insert are the same as those used in the blade. In some example embodiments, the abrasive particles used in the insert are different from those used in the blade. In some example embodiments, different insert compositions may be used within the different regions of a blade, i.e., cone, shoulder, and/or gage. In some example embodiments, different insert compositions may be used on two or more blades.

One suitable method of forming an insert in accordance with the present disclosure is a hot pressing method. The hot pressing process begins with forming a mold which defines the dimensions of the insert. The mold may be made of any suitable material known in the art, such as graphite. In one embodiment, the mold comprises a block having one or more holes (recesses or openings) and at least an upper and a lower plunger positioned at each end of the hole. Alternatively, a series of upper and lower plungers may be used. The upper and lower plungers may be used to define the height of the insert. Alternatively, the hole may have a fixed bottom and only an upper plunger may be used. In one example embodiment, when forming a single long insert to be used to span the blade, the width of the hole may define the insert height and a plunger may define a side of the insert. After forming the mold, powder of a suitable material is loaded into the holes with the lower plungers in place. Subsequently, the upper plunger is placed into the hole, "capping" the hole shut. The mold assembly may then be pre-pressed in a press. In some example embodiments, when the powder includes encapsulated abrasive particles, the pre-press is conducted at a much lower temperature than the subsequent press cycle (i.e., a cold press cycle). The mold assembly is then placed in a hot press furnace and subjected to sufficient temperature and pressure conditions for forming an insert.

Alternate methods of forming an insert may be used. For example, a high pressure, high temperature (HPHT) process for sintering diamond or cubic boron nitride may be used. Such a process has been described in U.S. Pat. Nos. 5,676,496 and 5,598,621 and their teachings are incorporated by reference herein. Other suitable methods for forming an insert may include ROC (rapid omnidirectional compaction), pneumatic isostatic forging, vacuum sintering, solid state or liquid phase sintering, spark plasma sintering, microwave sintering, and gas phase sintering processes. Another suitable method for hot-compacting pre-pressed powder mixtures is hot isostatic pressing, which is known in the art. See Peter I. Price and Steven P. Kohler, "Hot Isostatic Pressing of Metal Powders", *Metals Handbook*, vol. 7, pp. 419-443 ($9^{th}$ ed. 1984). Another suitable method for forming an insert may include infiltration of an insert mold. In such a method, the infiltration metal binder used to form the insert has a higher melting temperature than the infiltration metal binder and any additional metal binders used to form the bit. Optionally, an insert formed using an infiltration method may additionally be subjected to a Hot Isostatic Pressure sintering process (HIP process). The HIP process can reduce (or even eliminate) voids and porosity to a minimum size and quantity such as less than 0.01% volume. Application of the HIP process can improve the toughness of an insert which can also result in greater bending strength of the insert which is beneficial when used with taller blades. The HIP process is described in more detail in U.S. Pat. No. 5,290,507, which is herein incorporated by reference in its entirety. The HIP process may be performed in a gaseous (inert argon or helium) atmosphere contained within a pressure vessel. The gaseous atmosphere as well as the material may be heated by a furnace within the vessel. HIP process pressures may generally extend upward to 45,000 psi with temperatures up to 1300° C. For example, for tungsten carbide containing materials, temperatures may range from 500 to 1200° C. and pressures may range from 15,000 to 45,000 psi. In the HIP process, the material may be placed in a hermetically sealed container, which deforms plastically at elevated temperatures. Prior to sealing, the container is evacuated, which may include a thermal out-gassing stage to eliminate residual gases in the material mass that may result in undersirable porosity, high internal stresses, dissolved contaminants, and/or oxide formation. One of ordinary skill in the art would appreciate based on the teachings of the present disclosure that with any of these methods temperatures must remain below the solidus temperature of the material used to form the insert (e.g., tungsten carbide). The HIP process may also be applied to any preformed blade segments or to the bit as a whole.

Figure 6:
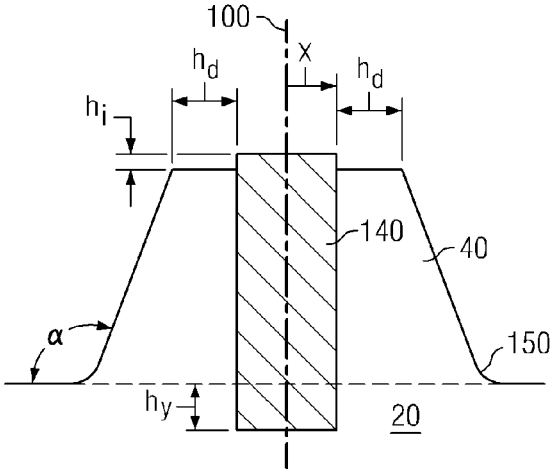
FIG. 6 shows a cross-sectional view of a blade of a drill bit according to one or more embodiments of the present disclosure.

FIG. 6 depicts a cross-sectional view of an elongated cylindrical insert 140 positioned within blade 40 such that insert 140 extends above the surface of blade 40 by a height of $h_i$ and extends within the bit body by a distance $h_y$. Insert 140 extends along the entire height of blade 40. The height $h_i$ may be in the range of from 0 to 30 mm, suitably in the range of from 0 to 26 mm, such as 1 mm, 2.5 mm, 5 mm, 8 mm, 10 mm, 15 mm, 20 mm, or 25 mm. The height $h_y$ may be in the range of from 0 to 25 mm, suitably in the range of from 0 to 15 mm, such as 1 mm, 2 mm, 5 mm, 7 mm, 10 mm, or 12 mm. The length of the insert may be more than 30 mm, in particular the length may range from 35 mm to 150 mm, for example 40 mm, 45 mm, 50 mm, 55 mm, 60 mm, 65 mm, 70 mm, 75 mm, 80 mm, 85 mm, 90 mm, 95 mm, 100 mm, 110 mm, 120 mm, 130 mm, or 140 mm. In some example embodiments, the insert may span more than 75% of the height of the blade, for example at least 85%, at least 90%, at least 95% or at least 99%.

In one or more embodiments, the height of the cutting structure (i.e., the blade height "$h_b$" and the insert extension height "$h_i$") may be at least 40 mm, suitably in the range of from 40 mm to 100 mm, for example 45 mm, 50 mm, 55 mm, 60 mm, 65 mm, 70 mm, 75 mm, 80 mm, 85 mm, 90 mm, or 95 mm.

Referring again to FIG. 6, insert 140 has a longitudinal axis 100 that is aligned perpendicular to the upper surface of the blade. In other example embodiments, the longitudinal axis of the insert may be aligned generally perpendicular to the upper surface of the blade or bit body. In particular, the longitudinal axis of the insert may be aligned at an acute angle to a reference line perpendicular to the upper surface of the blade and may be oriented in substantially the same direction as the rotation of the bit so as to enhance removal of the formation. The acute angle may be ±30 degrees from the perpendicular reference, suitably ±15 degrees. Insert 140 is embedded within blade 40 a distance "$h_d$" from the side of blade 40. In some example embodiments, the insert may be positioned within the blade such that distances "$h_d$" are at least 2.5 mm, in particular at least 5 mm. Although insert 140 is depicted as centered between the leading and trailing edges, other placements are intended to be within the scope of the present disclosure, for example the insert may be located closer to the leading edge than the trailing edge of the blade or vice versa. The dimensions of the insert as well as the positioning on the bit may vary depending on the application, in particular depending on the formation to be drilled. Although the insert is described with a rectangular cross-sectional profile, other shapes are intended to be within the scope of the present disclosure, for example conical, triangular, trapezoidal, polygonal, elliptical, oval, etc. The insert may be of any suitable diameter, for example in the range of from 5 mm to 20 mm, such as 8 mm, 10 mm, 11 mm, 13 mm, 15 mm, 16 mm, 17 mm, or 19 mm. Further, although the insert is depicted as having an upper exposed end face which is planar, non-planar shapes are intended to be within the scope of the present disclosure. Examples of non-planar shapes may be symmetrically or asymmetrically shaped and may include semi-round, domed, saddle-shaped, lobed, pyramidal, some of which are described, in particular in FIG. 1, in U.S. Pat. No. 6,394,202, which is assigned to the present assignee and is incorporated herein by reference in its entirety. The combination of a taller blade height and a longer insert than typically used provides for an improved blade design which results in an impregnated drill bit having an improved ROP (rate of penetration) while maintaining durability. Typically, ROP and durability are inapposite performance characteristics. That is, for greater ROP, increased rates of abrasive particle (e.g., diamond) exposure are necessary (and thus less wear resistance of the matrix material in which the abrasive particles are impregnated); however, for greater durability, greater wear resistance of the matrix material is desirable so that the bit does not wear away as quickly.

In one or more embodiments, at least one blade may contain one or more supplemental inserts positioned such that the longitudinal axis is aligned horizontal to the upper surface of the blade. These supplemental inserts may be positioned within the blade in any suitable configuration. In some example embodiments, at least one blade contains one or more inserts positioned such that the longitudinal axis is aligned perpendicular to the upper surface of the blade and one or more supplemental inserts with the longitudinal axis aligned horizontal to the upper surface of the blade, in particular with the supplemental horizontal inserts positioned in between the inserts aligned perpendicular to the upper surface of the blade.

Figure 7:
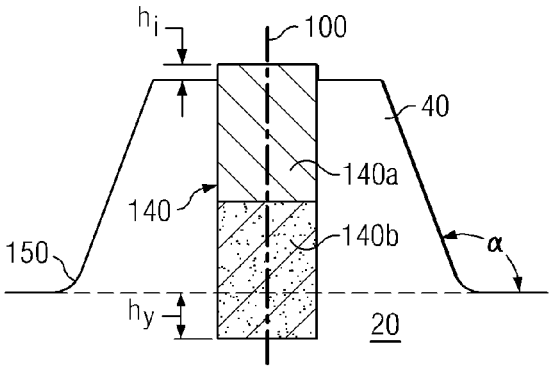
FIG. 7 shows a cross-sectional view of a blade of a drill bit according to one or more embodiments of the present disclosure.
Figure 14:
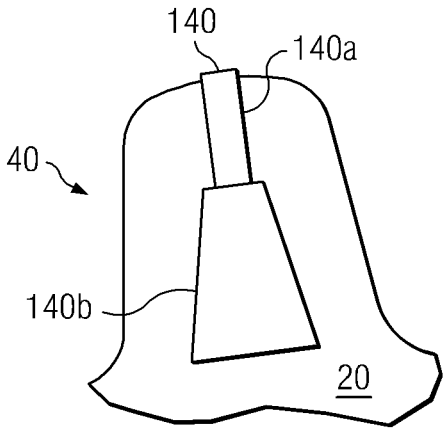
FIG. 14 shows a cross-sectional view of a blade of a drill bit according to one or more embodiments of the present disclosure.

In one or more embodiments, the insert may be formed using more than one insert segment. Methods of preparing, composition, geometry, etc. of the insert segments may be the same as described above for the inserts although the segments have a shorter length. As shown in FIG. 7, the insert 140 may include two cylindrical insert segments 140*a*, 140*b* attached along the end faces of the insert segments. The insert segments are depicted as being attached such that the longitudinal axes of the insert segments are substantially aligned. However, the insert segments may be attached such that the longitudinal axes of the insert segments are not substantially aligned, for example the insert segments may be attached such that at least 25% of the cross-sectional area of the end faces overlap, in particular at least 50% or at least 75%. As used herein, "substantially aligned" along the longitudinal axes of the insert segments is understood to mean that the longitudinal axis of one insert segment is within 2 mm, preferably within 1 mm, more preferably within 0.5 mm, of the longitudinal axis of the other insert segment. Insert segments 140*a*, 140*b* are shown as having substantially the same length; however, in other example embodiments, the insert segments 140*a*, 140*b* may have different lengths, diameters, and/or geometries. For example, FIG. 14 depicts a partial cross-sectional view of a cylindrical insert segment 140*a* having a smaller diameter than a second conical insert segment 140*b* attached thereto to form insert 140.

The insert segments may also differ with respect to one or more properties selected from composition, particle size distribution, hard particle content, abrasive particle content, metal binder content, hardness, erosion resistance, abrasion resistance, and toughness. In some embodiments, the insert segment proximate the upper surface of the blade has a lower hardness than the insert segment proximal the bit body. In some example embodiments, the insert segment proximate the upper surface of the blade has a greater hardness than the insert segment proximate the bit body. In some example embodiments, the insert segment proximate the upper surface of the blade contains abrasive particles having a lower average particle size than the insert segment proximate the bit body. In some example embodiments, the insert segment proximate the upper surface of the blade contains abrasive particles having a greater average particle size than the insert segment proximate the bit body. In some example embodiments, the insert segment proximate the bit body has a greater concentration of abrasive particles than the insert segment proximate the upper surface of the blade. In some example embodiments, the insert segment proximate the bit body has a lower concentration of abrasive particles than the insert segment proximate the upper surface of the blade. The properties, for example average particle size and concentration, will depend upon the application.

The insert segments may be attached to each other using an adhesive, an LS (liquid sintering) bond material, a braze material, a solder material, a weld material, and combinations thereof. The adhesive may be any adhesive capable of attaching the insert segments together, such as super glue. The attachment methods may include adhesion, brazing, soldering, LS bonding, and welding. Preferably, the welding methods include laser welding and plasma welding. Using two or more insert segments attached along the end faces can provide one or more of the following improvements as compared to a unitary insert with similar dimensions: greater density (i.e., less porosity/voids); greater hardness; a simpler and less costly mold can be used and re-used; and lower temperatures and/or shorter time periods the insert is exposed to elevated temperatures can be used to form the insert which in turn can result in achieving the desired density with less degradation to the diamond or other abrasive particles.

Figure 15:
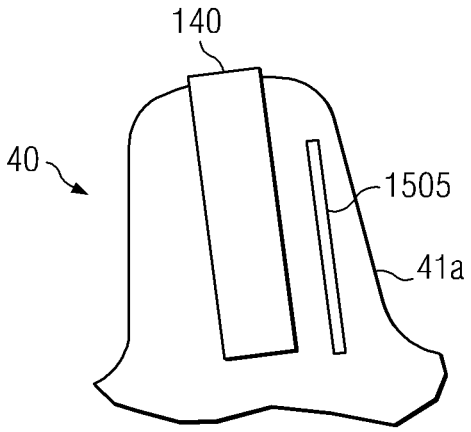
FIG. 15 shows a cross-sectional view of a blade of a drill bit according to one or more embodiments of the present disclosure.

In one or more embodiments, at least one blade may comprise one or more structural elements. The structural element may be formed of any suitable rigid material capable of imparting strength (also referred to as transverse rupture strength) and/or toughness to the blade, for example metals or metal alloys, carbon fibers, and composite materials. Suitable metals or metal alloys may include any metal or metal alloy which has a melting temperature above the processing temperatures, for example nickel, steel, niobium, molybdenum, titanium, mixtures and alloys thereof. Suitable composite materials may include metal carbides. The structural element may be of any suitable size or geometry. At least one of the structural elements may be positioned vertically within the blade (i.e., perpendicular to the surface of the bit). Suitably, the structural element may span at least 75% of the height of the blade, in particular at least 85% of the height of the blade. In some example embodiments, the structural element may be formed by attaching multiple segments. In some example embodiments, the structural element may be a shaped in the form of a mesh, for example a nickel alloy or steel mesh, having a thickness in the range of 0.004 to 0.035 inches (0.1 to 0.9 mm) and which spans at least a portion of the length of the blade in the radial direction. The mesh may span a majority of the length of the blade, in particular the entire length of the blade. In some example embodiments, the structural element may be generally cylindrical, such as carbon fibers, such as carbon fibers with a high strength to weight ratio, silicon carbide fibers, graphite coated fibers, metal or composite material posts, pins, etc. The cylindrical structural element may be solid or have a hollow interior (i.e., tubular). In some example embodiments, one or more generally cylindrical structural elements may be uniformly positioned throughout at least a portion of the blade. In some example embodiments, one or more structural elements may be disposed proximate the leading and/or trailing sides of at least a portion of the blade. In some example embodiments, a structural element may have a material applied to at least a portion of the surface thereof in order to improve attachment within the blade. Suitable materials include metal carbides, such as tungsten carbide. In some example embodiments, a blade may contain at least one insert and at least one structural element. FIG. 15 depicts a cross-sectional view of a blade 40 containing an insert 140 and a structural element 1505 disposed proximate the leading side 41*a* of the blade 40.

Various manufacturing techniques may be used to form an impregnated drill bit of the present disclosure. The manufacturing process may begin with the fabrication of a mold having the desired bit body shape and component configuration, including blade geometry. The mold may be formed from any suitable material, for example graphite. A shank and any formers may also be loaded into the mold cavity. Formers may include a blank for the fluid plenum (i.e., "crow's foot"), blanks for nozzles (ports), blanks for PDC cutting element pockets, blanks for channels, and blanks to form recesses for later attachment of inserts. Additionally or alternatively, one or more inserts may be placed within the mold cavity. A mixture of matrix material and abrasive particles may be loaded into the mold cavity by hand (i.e., handpacked) in the desired location, for example in one or more regions that will form the blade. A material may be loaded into the mold in the form of a powder, slurry, paste, tape, clay-like material, a preformed section (segment), and combinations thereof. To be moldable, such as a slurry, paste or clay-like material, such materials may have a viscosity of at least about 250,000 cP (centipoise). For example, such materials may have a viscosity of at least 1,000,000 cP, or at least 5,000,000 CP, or at least 10,000,000 cP. When multiple materials are used within different segments or layers of a bit, the materials may be placed in corresponding regions of the mold cavity. The different materials may be loaded into the mold cavity using the same or a different form (e.g., one region using a tape and another region using a moldable slurry). The other segments or layers of the blade may be filled with a different material. Optionally, a thin divider may be used to separate the materials from one another such as a plastic material or metal sheet, such as a copper metal sheet. When using a metal sheet, it may preferably be left in place during infiltration of the mold. Alternatively, at least a portion of the blade may be preformed and then placed into the mold cavity to be subsequently infiltrated to form the bit. Such preformed blade segments may be formed in a similar manner but using one or more smaller molds with cavities shaped to form the desired blade. The preformed blade segment may include one or more inserts or recesses (openings or sockets) for attaching inserts either before or after infiltration of the bit. The mold for the blade may then be subjected to any of the processes used to form an insert, as discussed above, in particular infiltrating, HIP, ROC, solid state or liquid phase sintering, spark plasma sintering, microwave sintering, and gas phase sintering processes.

Hard particles and optionally a metal binder powder and/or abrasive particles, may be loaded on top of the materials forming the blade portions to form a portion of the bit body. In some example embodiments, multiple materials may be used to form different regions of the bit body. Shoulder powder may then be loaded on top of the bit body powder. Shoulder powder may be any suitable material capable of being machined, for example a combination of tungsten and nickel.

Cubes of infiltrant metal binder may be placed on top of the powder and the mold subjected to sufficient temperatures to allow the molten infiltrant metal binder to infiltrate the powder in the mold cavity. For example, during the infiltration process, the bit may be held at an elevated temperature (>1800° F.) for a period of time on the order of 0.75 to 2.5 hours, depending on the size of the bit. During infiltration, matrix material loaded into the mold cavity may be carried down with the molten infiltrant to fill any gaps between the particles. One skilled in the art would appreciate based on the teachings of the present disclosure that other techniques such as casting may alternatively be used.

In some example embodiments, an insert may be selected and placed into the mold cavity along with the other materials and subsequently subjected to an infiltration process thereby attaching the insert to the bit. In some example embodiments, end faces of at least two cylindrical insert segments are attached with an adhesive and placed within the mold cavity along with the other materials and subsequently infiltrated attaching the insert to the bit. In other example embodiments, at least two insert segments are used; however, an insert segment (although more than one insert segment may be attached together) may first be attached along an end face to an insert former and the assembly placed in the mold cavity with the former adjacent the surface of the mold cavity creating a socket in the upper surface of the blade. After infiltration, an insert segment may subsequently be attached in the socket formed by the insert former by brazing, adhesive, mechanical means such as interference fit, or the like. In some example embodiments, one or more structural elements may be selected and placed into the blade material and subsequently infiltrated. Impregnated drill bits having tall blades with such inserts can exhibit an improvement in bit durability and ROP. In some example embodiments, formers may be placed in the mold cavity to form recesses (holes or sockets), and after the infiltration process, the inserts may be selected and attached by any suitable method, for example adhesion, brazing, soldering, LS bonding, and welding methods. Preferably, the welding methods include laser welding and plasma welding. Brazing methods include furnace brazing as well as torch brazing methods. In some example embodiments, a combination of attachment methods for a plurality of inserts may be used, for example some inserts may be attached by an infiltration method while some inserts may be attached by a brazing method. In some example embodiments, at least a portion of one or more blades, especially the shoulder region, may alternate attachment methods between adjacent inserts, for example one insert may be attached via an infiltration method and an adjacent insert may be attached via a brazing method.

Embodiments of the present disclosure may provide at least one of the following advantages: improved ROP; improved bit durability; improved cost-effectiveness (e.g., lower cost per foot of drilling costs); and ease of manufacturing.

While the above embodiments describe a variety of matrix materials, the particular composition of matrix materials selected may be based on both the desired mechanical properties as well as properties such as the ability to infiltrate. Selecting a matrix material that can infiltrate easily and reliably is desirable especially the taller blades which require longer infiltration paths and therefore longer infiltration times and perhaps higher temperatures which can adversely affect the diamond abrasive particles. While the above embodiments have been described with respect to a plurality of blades, it is intended to be included in the scope of the present disclosure that any number of blades, whether primary and/or secondary, may be used. For example, the impregnated drill bit may have 2 or more primary blades, in particular 3, 4, 5, 6, etc. Additionally, the impregnated drill bit may have 2 or more secondary blades, in particular 6, 9, 12, 15, 20, 24, etc. The amount and type (e.g., primary or secondary) of blades will depend on a variety of factors. Such factors include the type of formation to be drilled, the size of the impregnated drill bit, drilling parameters (e.g., load, fluid flow, revolutions per minute (RPM)), and whether a directional or horizontal drilling application.

While the above embodiments have been described with respect to blades having a substantially uniform height (thickness), no limitation is intended on the scope of the present disclosure by such a description. It is intended to be included in the scope of the present disclosure that the blades may vary in height (thickness). For example, the height of the blade may decrease in the cone region and/or gage region. Alternatively, the height of the blade may increase in the gage region. Further, the surface of the blade has been depicted as having a uniform surface; however, it is intended to be included in the scope of the present disclosure that the blades may have a non-uniform surface.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit comprising:

a bit body having a central longitudinal axis and a lower end face for engaging a rock formation;

a plurality of blades having an upper surface and side surfaces extending from the bit body and separated by a plurality of channels therebetween; and at least one insert having a central longitudinal axis which is positioned within at least one of the plurality of blades such that the insert axis is generally perpendicular to the upper surface of the blade, wherein the at least one insert comprises a first matrix material impregnated with a plurality of first abrasive particles, and wherein at least a portion of at least one of the plurality of blades comprises a second matrix material impregnated with a plurality of second abrasive particles, the insert spans more than 75% of the height of the blade, and at least a portion of the at least one blade has a blade height of at least 40 mm.

2. The bit of claim 1, wherein the blade height is at least 50 mm.

3. The bit of claim 1, wherein the insert spans 100% of the height of the blade.

4. The bit of claim 1, wherein the first and second abrasive particles are each selected from the group consisting of synthetic diamond, natural diamond, reclaimed natural diamond grit, reclaimed synthetic diamond grit, cubic boron nitride, thermally stable polycrystalline diamond and combinations thereof.

5. The bit of claim 1, wherein at least a portion of the plurality of second abrasive particles further comprise a shell of an additional material.

6. The bit of claim 1, wherein the second abrasive particles comprise abrasive particles having a shell of a third matrix material and abrasive particles having a shell of a fourth matrix material, and wherein the third matrix material differs from the fourth matrix material.

7. The bit of claim 1, wherein the first abrasive particles are the same as the second abrasive particles in the blades.

8. The bit of claim 1, wherein the first abrasive particles are different from the second abrasive particles in the blades.

9. The bit of claim 1, wherein the first abrasive particles further comprise a shell of a matrix material.

10. The bit of claim 1, wherein the insert is formed by attaching two or more insert segments.

11. The bit of claim 10, wherein the insert segments have one or more different properties.

12. The bit of claim 11, wherein the insert segment proximate the upper surface of the blade has a lower hardness than the insert segment proximal the bit body.

13. The bit of claim 11, wherein the insert segments comprise abrasive particles, and the insert segment proximate the upper surface of the blade contains abrasive particles having a lower average particle size than the insert segment proximate the bit body.

14. The bit of claim 11, wherein the insert segments comprise abrasive particles, and the insert segment proximate the upper surface of the blade contains abrasive particles having a greater average particle size than the insert segment proximate the bit body.

15. The bit of claim 10, wherein the insert segments comprise abrasive particles, and the insert segment proximate the bit body has a different concentration of abrasive particles than the insert segment proximate the upper surface of the blade.

16. The bit of claim 10, wherein the insert segments are attached using a material selected from an adhesive, a braze material, a solder material, a weld material, and combinations thereof.

17. The bit of claim 16, wherein the insert segments are attached together using an adhesive and subsequently attached within the blade by an infiltration process.

18. The bit of claim 1, wherein at least one of the plurality of blades has a varying width along at least a portion of the blade height.

19. The bit of claim 1, wherein the at least one of the plurality of blades is divided into a plurality of horizontal layers, and wherein at least two of the plurality of layers comprise different materials.

20. The bit of claim 1, wherein the at least one of the plurality of blades is divided into a plurality of vertical segments, and wherein at least two of the plurality of segments comprise different materials.

21. The bit of claim 1, wherein the at least one of the plurality of blades comprises at least a first region comprising the second matrix material impregnated with the plurality of second abrasive particles and at least a second region comprising a third matrix material.

22. The bit of claim 21, wherein the first region and the second region are positioned along a surface of the blade and the first region is more wear resistant than the second region such that the second region wears faster than the first region during engagement with a rock formation.

23. The bit of claim 1, wherein the plurality of blades comprise blades having at least two different blade heights and at least two different channel depths.

24. The bit of claim 1, wherein the plurality of blades comprise one or more root radius regions located between the side of the blade and an adjacent channel, and wherein the root radius region comprises a material which is free of abrasive particles.

25. The bit of claim 24, wherein the material free of abrasive particles is a metal or matrix material.

26. The bit of claim 24, wherein the side surfaces of the blades comprise a leading side and a trailing side, and wherein at least a portion of the leading side surface of the at least one blade comprises a material free of abrasive particles.

27. The bit of claim 1, wherein the at least one blade comprises a first region of a matrix material formed using an infiltrated metal binder and a first metal binder, and wherein the first metal binder has a lower melting temperature than the infiltrated metal binder.

28. The bit of claim 27, wherein the at least one blade further comprises a second region of a matrix material formed of a second metal binder, wherein the first region is positioned adjacent the upper surface of the blade; the second region is positioned within the blade between the first region and the bit body; the first metal binder has the lowest melting temperature; and the second metal binder has an intermediate melting temperature as compared to the first metal binder and the infiltrated metal binder.

29. The bit of claim 27, wherein the plurality of blades comprise a first blade having a first blade height and a second blade having a second blade height; wherein the first blade comprises the first region, the second blade comprises a second region comprising a matrix material formed using the infiltrated metal binder and a second metal binder, the first region and the second region contain abrasive particles, the first blade height differs from the second blade height, the first metal binder differs from the second metal binder, and the infiltrated metal binder differs from the first and second metal binder.

30. The bit of claim 29, wherein the first metal binder is provided as a shell of metal binder on at least a portion of the abrasive particles used to form the first region and the second metal binder is provided as a shell of metal binder on at least a portion of the abrasive particles used to form the second region.

31. The bit of claim 1, wherein the plurality of blades comprise a first blade having a first blade height of at least 40 mm and a second blade having a second blade height; wherein the first blade comprises a matrix material comprising the plurality of second abrasive particles, the second blade comprises a matrix material comprising a plurality of third abrasive particles, and the second abrasive particles differ from the third abrasive particles.

32. The bit of claim 1, wherein the bit further comprises at least one structural element positioned within the at least one blade.

33. The drill bit of claim 1, wherein a majority of volume of the at least one blade comprises the second matrix material impregnated by the second abrasive particles.

34. The drill bit of claim 1, wherein the portion of the at least one blade formed from the second matrix material impregnated by the second abrasive particles comprises a majority of the blade height.

35. The drill bit of claim 1, wherein the second matrix material comprises tungsten carbide hard particles and a binder material, and wherein the plurality of second abrasive particles comprises diamond.

36. A method of manufacturing a drill bit comprising:

selecting an insert;

forming a bit body having a plurality of blades disposed thereon; and attaching at least a portion of the insert within at least one of the blades, wherein the insert comprises a first matrix material impregnated with a plurality of first abrasive particles, and wherein at least a portion of the blades comprise a second matrix material impregnated with a plurality of second abrasive particles, the portion of the insert embedded within the blade spans more than 75% of the height of the blade, and at least a portion of the blade containing the insert has a blade height of at least 40 mm.

37. The method of claim 36, wherein the insert is formed by attaching two or more insert segments.

38. The method of claim 37, wherein the insert segments are attached together using a material selected from an adhesive, a braze material, a solder material, a weld material, and combinations thereof.

39. The method of claim 38, wherein the insert segments are attached together using an adhesive and subsequently attached within the blade by an infiltration process.

40. The method of claim 36, wherein forming the bit body and blades comprises forming one or more preformed blade segments, placing the preformed blade segments into a mold, and infiltrating the mold with a first infiltrated metal binder, wherein the preformed blade segments are formed by infiltrating a mold with a second infiltrated metal binder and subsequently subjecting the preformed blade segments to a HIP process.

41. The method of claim 36, wherein a majority of volume of the at least one blade comprises the second matrix material impregnated by the second abrasive particles.

42. The method of claim 36, wherein the portion of the at least one blade formed from the second matrix material impregnated by the second abrasive particles comprises a majority of the blade height.

43. A drill bit comprising:

a bit body having a lower end face for engaging a rock formation; and a plurality of blades extending from the bit body and separated by a plurality of channels therebetween, the plurality of blades having one or more root radius regions extending at least along a transitional radiused surface between a side of the blade and an adjacent channel, wherein at least a portion of at least one of the plurality of blades is formed of a matrix material impregnated with a plurality of abrasive particles, at least one of root radius regions being formed of a material substantially free of abrasive particles, the matrix material impregnated with the plurality of abrasive particles being adjacent to the at least one root region along a width of the blade, and at least a portion of at least one of the blades has a blade height of at least 60 mm.

44. The bit of claim 43, wherein the abrasive particles are selected from the group consisting of synthetic diamond, natural diamond, reclaimed natural diamond grit, reclaimed synthetic diamond grit, cubic boron nitride, thermally stable polycrystalline diamond and combinations thereof.

45. The bit of claim 43, wherein the abrasive particles further comprise a shell of an additional material.

46. The bit of claim 43, wherein a major portion of the plurality of blades have an abrasive particle contiguity of at most 20%.

47. The bit of claim 43, wherein the plurality of blades comprise at least one primary blade and at least one secondary blade, and wherein the at least one secondary blade has a blade height which is less than the at least one primary blade.

48. The bit of claim 43, wherein the plurality of blades comprise a first blade having a first blade height and a second blade having a second blade height; wherein the first blade comprises a matrix material formed using an infiltrated metal binder and a first metal binder, the second blade comprises a matrix material formed using the infiltrated metal binder and a second metal binder, the first blade height differs from the second blade height, the first metal binder differs from the second metal binder, and the infiltrated metal binder differs from the first and second metal binder.

49. The bit of claim 48, wherein the first metal binder is provided as a shell of metal binder on at least a portion of the abrasive particles used to form the first blade and the second metal binder is provided as a shell of metal binder on at least a portion of the abrasive particles used to form the second blade.

50. The bit of claim 43, wherein the plurality of blades comprise a first blade having a first blade height and a second blade having a second blade height; wherein the first blade comprises a matrix material comprising a plurality of first abrasive particles, the second blade comprises a matrix material comprising a plurality of second abrasive particles, and the first abrasive particles differ from the second abrasive particles.

51. The bit of claim 43, wherein the abrasive particles comprise abrasive particles having a shell of a first matrix material and abrasive particles having a shell of a second matrix material, and wherein the first matrix material differs from the second matrix material.

52. The bit of claim 43, wherein at least one of the plurality of blades has a varying width along at least a portion of the blade height.

53. The bit of claim 43, wherein the at least one of the plurality of blades is divided into a plurality of horizontal layers, and wherein at least two of the plurality of layers comprise different materials.

54. The bit of claim 43, wherein the at least one of the plurality of blades is divided into a plurality of vertical segments, and wherein at least two of the plurality of segments comprise different materials.

55. The bit of claim 43, wherein the at least one of the plurality of blades comprises at least a first region comprising a first matrix material impregnated with a plurality of abrasive particles and at least a second region comprising a second matrix material.

56. The bit of claim 55, wherein the first region and the second region are positioned along a surface of the blade and the first region is more wear resistant than the second region such that the second region wears faster than the first region during engagement with a rock formation.

57. The bit of claim 56, wherein the blade has a length extending radially from a first end to a second end and further comprises a plurality of first regions and a plurality of second regions positioned along the length of the blade in an alternating manner.

58. The bit of claim 56, wherein a first plurality of first regions is positioned on a first of the plurality of blades and a second plurality of first regions is positioned on a second of the plurality of blades with the second plurality of first regions on the second blade being staggered in a radial direction with respect to the first plurality of first regions positioned on the first blade.

59. The bit of claim 58, further comprising a first plurality of second regions positioned on the first blade alternating with the first plurality of first regions and a second plurality of second regions positioned on the second blade alternating with the second plurality of first regions, wherein the second plurality of second regions on the second blade are staggered in a radial direction with respect to the first plurality of second regions positioned on the first blade.

60. The bit of claim 43, wherein a first region of the at least one blade comprises a matrix material formed using an infiltrated first metal binder and at least one additional metal binder, and wherein the additional metal binder has a lower melting temperature than the infiltrated metal binder.

61. The bit of claim 60, wherein the at least one blade further comprises a second region of a matrix material formed of a second metal binder, wherein the first region is positioned adjacent the upper surface of the blade; the second region is positioned within the blade between the first region and the bit body; the first metal binder has the lowest melting temperature; and the second metal binder has an intermediate melting temperature as compared to the first metal binder and the infiltrated metal binder.

62. The bit of claim 60, wherein the plurality of blades comprise a first blade having a first blade height and a second blade having a second blade height; wherein the first blade comprises the first region, the second blade comprises a second region comprising a matrix material formed using the infiltrated metal binder and a second metal binder, the first region and the second region contain abrasive particles, the first blade height differs from the second blade height, the first metal binder differs from the second metal binder, and the infiltrated metal binder differs from the first and second metal binder.

63. The bit of claim 43, wherein the plurality of blades comprise a first blade having a first blade height of at least 60 mm and a second blade having a second blade height; wherein the first blade comprises a matrix material comprising a plurality of first abrasive particles, the second blade comprises a matrix material comprising a plurality of second abrasive particles, and the first abrasive particles differ from the second abrasive particles.

64. The bit of claim 43, wherein the bit further comprises at least one structural element positioned within the at least one blade.

65. The bit of claim 43, wherein the material free of abrasive particles is a metal or matrix material.

66. The bit of claim 43, wherein the blade comprises a leading side and a trailing side and the root radius region adjacent the leading side comprises the matrix material which is free of abrasive particles.

67. The bit of claim 43, wherein at least a portion of a side surface of at least one blade comprises a matrix material free of abrasive particles.

68. The drill bit of claim 38, further comprising at least one insert positioned within at least one of the plurality of blades, wherein the at least one insert comprises a matrix material impregnated with a plurality of abrasive particles.

69. A method of manufacturing a drill bit comprising:

providing a mold configured to form a bit body with a plurality of blades extending therefrom separated by a plurality of channels therebetween;

placing a matrix material containing a plurality of abrasive particles within the mold to form at least a portion of the plurality of blades;

placing a matrix material being substantially free of abrasive particles within the mold corresponding to a root radius region of at least one blade, the root radius region extending at least along a transitional radiused surface between a side of the blade and an adjacent channel, the root radius region being adjacent, along a width of the blade, to the matrix material containing the plurality of abrasive particles; and infiltrating the matrix material with an infiltrated metal binder forming the drill bit, wherein at least one of the blades has a blade height of at least 60 mm.

* * * * *

UNITED STATES PATENT AND TRADEMARK OFFICE

CERTIFICATE OF CORRECTION

PATENT NO. : 9,004,199 B2
APPLICATION NO. : 12/820554
DATED : April 14, 2015
INVENTOR(S) : Yuri Burhan et al.

It is certified that error appears in the above-identified patent and that said Letters Patent is hereby corrected as shown below:

Title page

Item (75) Inventors:

Third inventor's name corrected from "Jonan Fulencheck" to --Jonan Fulenchek--.

Signed and Sealed this
Eighth Day of December, 2015

Michelle K. Lee

Michelle K. Lee
*Director of the United States Patent and Trademark Office*